US011052672B2

(12) United States Patent
Fujita

(10) Patent No.: US 11,052,672 B2
(45) Date of Patent: Jul. 6, 2021

(54) PRINTING SYSTEM

(71) Applicant: Brother Kogyo Kabushiki Kaisha, Nagoya (JP)

(72) Inventor: Keisuke Fujita, Inazawa (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 16/669,848

(22) Filed: Oct. 31, 2019

(65) Prior Publication Data

US 2020/0130368 A1 Apr. 30, 2020

(30) Foreign Application Priority Data

Oct. 31, 2018 (JP) ..... JP2018-206082

(51) Int. Cl.
*B41J 2/325* (2006.01)

(52) U.S. Cl.
CPC ..... *B41J 2/325* (2013.01)

(58) Field of Classification Search
CPC ..... B41J 2/325; B41J 2/35
See application file for complete search history.

(56) References Cited

U.S. PATENT DOCUMENTS 6,010,258 A * 1/2000 Tomita ..... B41J 2/325 347/172
6,313,860 B1 11/2001 Suzuki et al.

FOREIGN PATENT DOCUMENTS

JP 2001-047715 A 2/2001
JP 2003-127448 A 5/2003
JP 2008-044205 A 2/2008

OTHER PUBLICATIONS

IP.com search (Year: 2020).*
Machine Translation of JP 2008044205 A, Sakamoto et al., Printing Method in Thermal Transfer Printer, Feb. 28, 2008 [Paragraphs 0001, 0009-0010, 0014-0021] (Year: 2008).*

* cited by examiner

*Primary Examiner* — Lisa Solomon
(74) *Attorney, Agent, or Firm* — Banner & Witcoff, Ltd.

(57) ABSTRACT

A printing system includes: a printing device including a thermal head, a supplier, a winder and a ribbon transport mechanism; a moving mechanism moving the printing device in a width direction of an ink ribbon; and a controller configured to: move the printing device in the width direction; when the printing device is moved for printing of a second row, rewind the ink ribbon; store the longest length of use of the ink ribbon by the printing in a first column of the ink ribbon; when printing with the thermal head proceeds to a second column, determine a transport amount of the ink ribbon based on the stored length; and after the first column of the ink ribbon is used by the printing, transport the ink ribbon based on the determined transport amount.

6 Claims, 13 Drawing Sheets

PRINTING SYSTEM

CROSS-REFERENCE TO RELATED APPLICATIONS

This application is based on and claims priority under 35 USC 119 from Japanese Patent Application No. 2018-206082 filed on Oct. 31, 2018, the contents of which are incorporated herein by reference.

TECHNICAL FIELD

The disclosure relates to a printing system.

BACKGROUND

There has been disclosed a thermal transfer printer. The thermal transfer printer is provided with a printing mechanism including an ink ribbon having a width dimension W that can be driven and controlled to be fed and rewound in the same direction as a traveling direction of an object to be printed and a thermal print head displaced together with the ink ribbon in a width direction of the ink ribbon. In the thermal transfer printer, after the ink ribbon is fed out and printing is performed, the ink ribbon is rewound by $(n-1)/n$ (where, n satisfies $n=W/w$) for a length-direction dimension d of a unit printing area E ($E=w\times d$, where w is a width-direction dimension of the area E, and d is a length-direction dimension of the area E) in a length direction of the ink ribbon after printing is performed in one unit printing area E on the ink ribbon. The thermal transfer printer performs printing by displacing the ink ribbon in the width direction of the ink ribbon by an amount corresponding to the width-direction width w of the unit printing area E, and performs printing using an unused portion over the entire width dimension W of the ink ribbon.

SUMMARY

Illustrative aspects of the disclosure may provide a printing system comprising: a printing device comprising: a thermal head; a supplier provided on a first side and configured to supply an ink ribbon to the thermal head; a winder provided on a second side that is opposite to the first side with respect to the thermal head and configured to wind the ink ribbon; and a ribbon transport mechanism configured to transport the ink ribbon between the supplier and the winder; a moving mechanism configured to move the printing device in a width direction of the ink ribbon; a storage; and a controller configured to: move the printing device in the width direction of the ink ribbon with the moving mechanism; in a case the printing device is moved for performing printing of a second row after performing printing of a first row with the thermal head, rewind the ink ribbon from the second side to the first side with the ribbon transport mechanism; store, in the storage, a length of use of the ink ribbon, the length stored being the longest length in a first column of the ink ribbon in the width direction; in a case printing with the thermal head proceeds to a second column, determine a transport amount of the ink ribbon based on the length stored in the storage in a case the printing with the thermal head proceeds to the second column; and after the first column in the width direction of the ink ribbon is used by the printing with the thermal head, transport the ink ribbon with the ribbon transport mechanism based on the determined transport amount.

In the printing system described above, after the first column of the ink ribbon in the width direction is used by printing with the thermal head, a length of use of the ink ribbon, which is the longest length in the first column of the ink ribbon, is stored in the storage. When printing with the thermal head proceeds to the second column, a transport amount of the ink ribbon is determined based on the length stored in the storage and the ink ribbon is transported. Accordingly, a possibility of occurrence of an excess or deficiency in the transport amount of the ink ribbon can be reduced. Accordingly, it is possible to reduce the possibility that, in a transport process, the rewinding amount of the ink ribbon is excessive and print marks overlap to cause faulty printing, or the rewinding amount of the ink ribbon is insufficient and an amount of ink ribbon not used for printing increases to cause waste.

BRIEF DESCRIPTION OF DRAWINGS

Illustrative embodiments of the disclosure will be described in detail based on the following figures, wherein.

DETAILED DESCRIPTION

In the above-described related-art thermal transfer printer, when a speed of a packaging material as a medium to be printed is not constant but changes, a position of a print mark on the ink ribbon changes due to the speed of the packaging material. Accordingly, there is a problem that, if a transport amount of the ink ribbon when printing with a thermal print head proceeds to the next column is not properly controlled, an excess or deficiency in the transport amount of the ink ribbon occurs, and thus the print marks overlap to cause faulty printing or an amount of ink ribbon not used for printing increases to cause waste.

Therefore, illustrative aspects of the disclosure provide a printing system which has a rewinding function for rewinding an ink ribbon, and prevents an excess or deficiency in a transport amount of the ink ribbon.

Overview of Printing System 1

One illustrative embodiment of the disclosure will be described with reference to the drawings. The printing system 1 is a system for performing thermal transfer printing. The printing system 1 performs printing on a print medium P (see FIG. 2) transport by an external apparatus 8 (see FIG. 3). A specific example of the external apparatus 8 includes a packaging machine that transports the packaging material. In this case, for example, the printing system 1 is used by being incorporated into a part of a transport line on which the print medium P is transported by the packaging machine.

Figure 1:
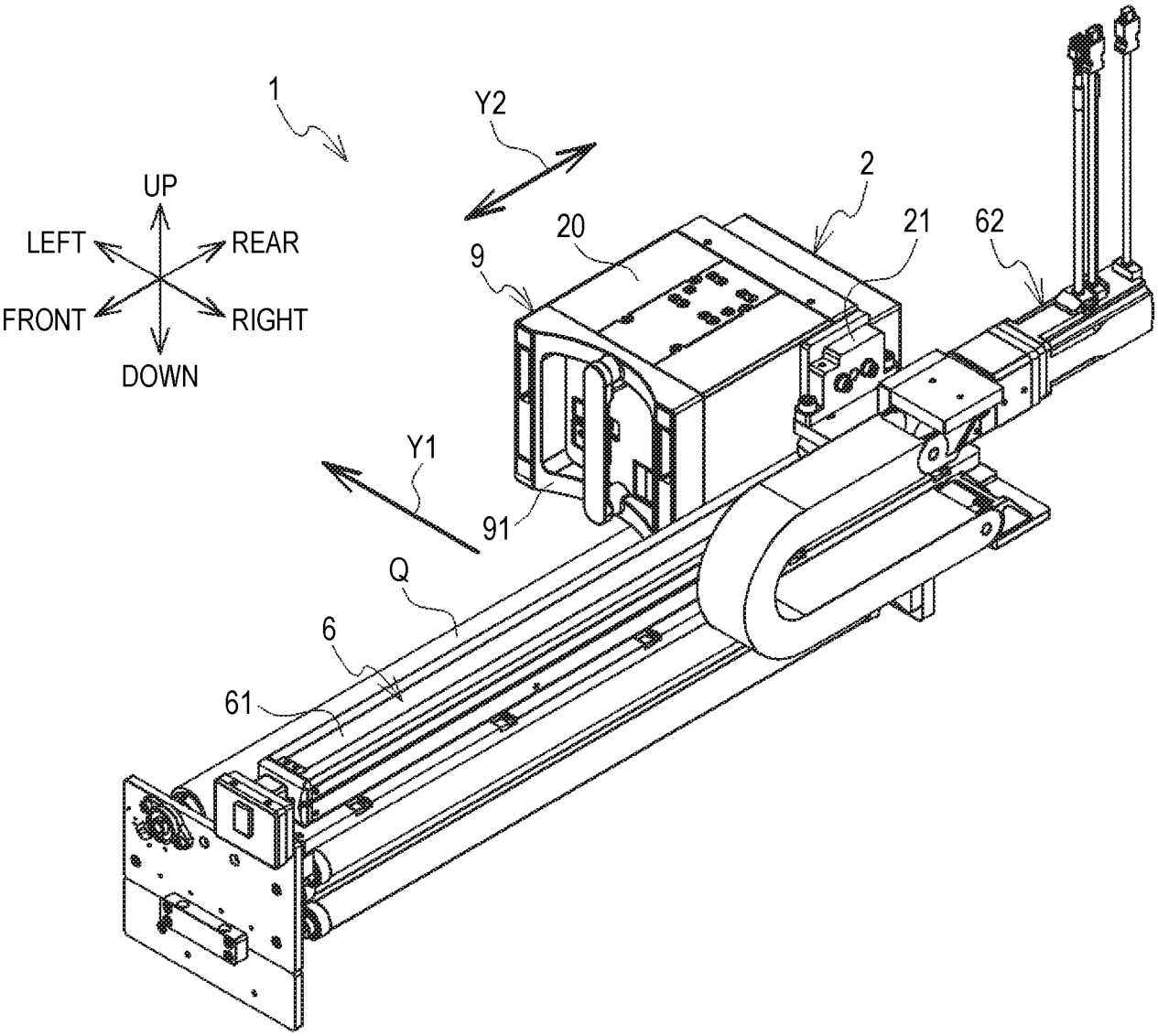
FIG. 1 is a perspective view of a printing system 1 (in a state where a cassette 9 is attached)

As illustrated in FIG. 1, the printing system 1 includes a printing device 2, a bracket 6, a controller 7 (see FIG. 3), and a platen roller Q. Hereinafter, in order to help understanding of the description of the drawings, the above, the below, the left, the right, the front, and the rear of each configuration included in the printing system 1 will be defined. The above, the below, the left, the right, the front, and the rear of the printing device 2 and the bracket 6 correspond to an upper side, a lower side, an obliquely upper left side, an obliquely lower right side, an obliquely lower left side, and an obliquely upper right side in FIG. 1, respectively. In FIG. 1, a transport direction of the print medium P coincides with the horizontal direction. The print medium P is transported in the left direction (direction of the arrow Y1) by the external apparatus 8.

Cassette 9

Figure 2:
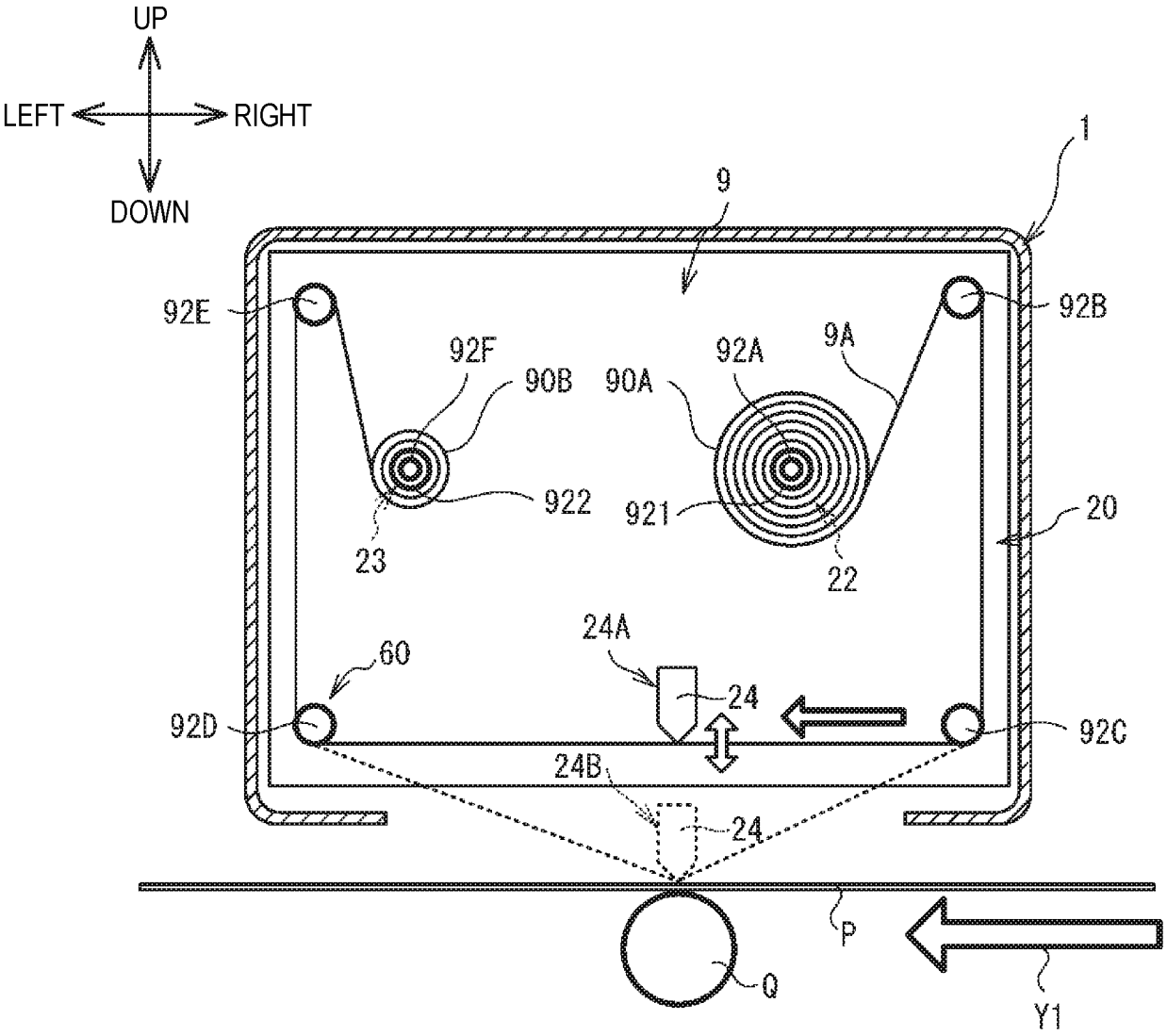
FIG. 2 is a diagram for explaining an operation of a printing device 2.

In the printing system 1, printing on the print medium P is performed in a state where the cassette 9 is attached to a cassette attachment unit 20 of the printing device 2. The printing device 2 performs printing by heating an ink ribbon 9A (see FIG. 2) of the cassette 9. As illustrated in FIG. 2, the cassette 9 includes a lid 91 (see FIG. 1), shafts 92A to 92F, a supply roll 90A, and a winding roll 90B. The shafts 92A to 92F are spindles that are rotatable around a rotation axis extending in the front-and-rear direction. The shafts 92A to 92F extend rearward from the rear surface of the lid 91.

The shafts 92A and 92F are arranged in the horizontal direction above the center of the lid 91 in the vertical direction. A spool 921 to which one end of the ink ribbon 9A is connected is attached to the shaft 92A. A spool 922 to which the other end of the ink ribbon 9A is connected is attached to the shaft 92F. In each of the spools 921 and 922, the ink ribbon 9A is wound in a roll. The supply roll 90A is configured by winding the ink ribbon 9A around the spool 921. The winding roll 90B is configured by winding the ink ribbon 9A around the spool 922.

The ink ribbon 9A is fed from the supply roll 90A by the printing device 2 and wound around the winding roll 90B. The shaft 92B is provided at the upper right corner of the lid 91. The shaft 92C is provided at the lower right corner of the lid 91. The shaft 92D is provided at the lower left corner of the lid 91. The shaft 92E is provided at the upper left corner of the lid 91. The ink ribbon 9A stretched between the supply roll 90A and the winding roll 90B is in contact with a part of a circumferential surface of each of the shafts 92B to 92E.

Platen Roller Q

As illustrated in FIGS. 1 and 2, the platen roller Q has a cylindrical shape. The platen roller Q is rotatable around a rotation axis extending in the front-and-rear direction. The printing device 2 is disposed above the platen roller Q. The print medium P and the ink ribbon 9A are sandwiched between the platen roller Q and a thermal head 24 of the printing device 2. The platen roller Q contacts the print medium P transport by the external apparatus 8 from below and presses the print medium P against the ink ribbon 9A.

Printing Device 2

Figure 3:
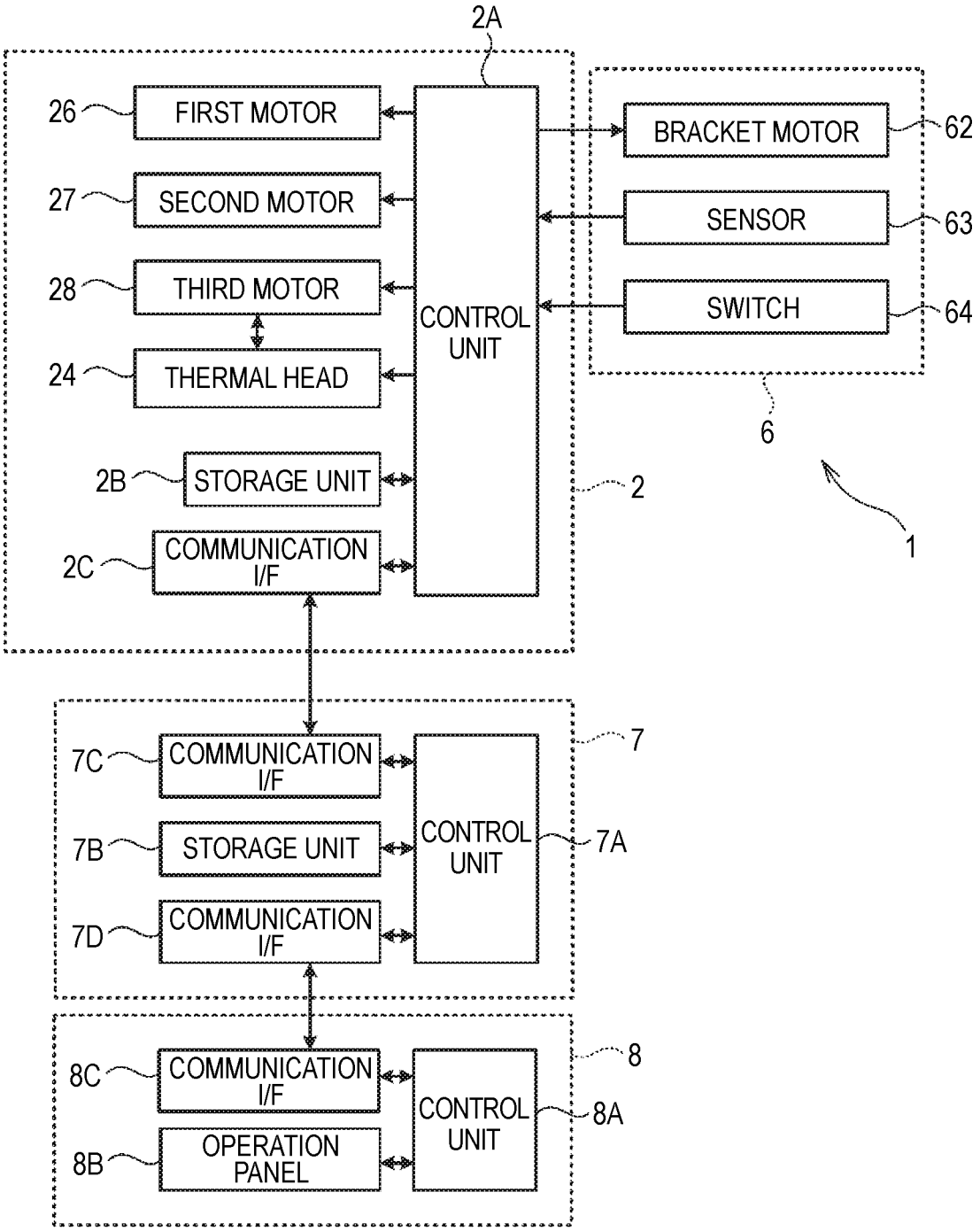
FIG. 3 is a block diagram illustrating an electrical configuration of the printing system 1.

The printing device 2 is a thermal transfer printer. As illustrated in FIGS. 2 and 3, the printing device 2 includes a supply unit 22, a winding unit 23, the thermal head 24, a control board (not illustrated), a first motor 26, a second motor 27, a third motor 28, and the like. When the cassette 9 illustrated in FIG. 2 is attached to the cassette attachment unit 20 of the printing device 2, the shaft 92A is connected to the supply unit 22 and the shaft 92F is connected to the winding unit 23. The supply roll 90A wound around the spool 921 of the shaft 92A is attached to the supply unit 22. The winding roll 90B wound around the spool 922 of the shaft 92F is attached to the winding unit 23.

The first motor 26 and the second motor 27 are stepping motors. The first motor 26 can rotate the supply roll 90A attached to the supply unit 22 by rotationally driving the supply unit 22. The second motor 27 can rotate the winding roll 90B attached to the winding unit 23 by rotationally driving the winding unit 23. When the first motor 26 and the second motor 27 rotate in a state where the cassette 9 is attached to the printing device 2, the ink ribbon 9A is transported between the supply roll 90A and the winding roll 90B in the printing device 2 while being guided in contact with the shafts 92B to 92E.

In detail, when the supply roll 90A and the winding roll 90B rotate in a forward rotation direction which is a counterclockwise direction, in a state where the printing device 2 in FIG. 2 is viewed from the front, the ink ribbon 9A is fed from the supply roll 90A and wound around the winding roll 90B. When the supply roll 90A and the winding roll 90B rotate in a reverse rotation direction which is the clockwise direction in a state where the printing device 2 in FIG. 2 is viewed from the front, the ink ribbon 9A is fed from the winding roll 90B and wound around the supply roll 90A.

The thermal head 24 is a line thermal head having a plurality of heating elements linearly arranged in the front-and-rear direction. The thermal head 24 contacts a portion stretched between the shafts 92C and 92D of the ink ribbon 9A transported from the supply roll 90A of the cassette 9 toward the winding roll 90B from above. The print medium P and the ink ribbon 9A are sandwiched between the thermal head 24 and the platen roller Q disposed below the printing device 2. The thermal head 24 performs printing on the print medium P by heating the ink ribbon 9A while pressing the ink ribbon 9A against the print medium P.

The third motor 28 is a stepping motor. The third motor 28 moves the thermal head 24 between head positions 24A and 24B via a gear in the vertical direction. The thermal head 24 approaches the platen roller Q by moving downward, and is separated from the platen roller Q by moving upward. The movement direction (vertical direction) of the thermal head 24 is orthogonal to the transport direction (horizontal direction) of the ink ribbon 9A transported between the shafts 92C and 92D. The head position 24B is a position where the thermal head 24 contacts the ink ribbon 9A and urges the ink ribbon 9A toward the platen roller Q. The head position 24A is a position where the thermal head 24 is disposed above the head position 24B and urging of the ink ribbon 9A to the platen roller Q is released.

Bracket 6

As illustrated in FIG. 1, the bracket 6 moves the printing device 2 in the front-and-rear direction (direction of the arrow Y2) orthogonal to the horizontal direction which is the transport direction of the print medium P (see FIG. 2). The bracket 6 includes a support portion 61, a bracket motor 62, a lead screw (not illustrated), and a ball screw (not illustrated). The support portion 61 has a substantially box shape that is long in the front-and-rear direction. The lead screw is disposed inside the support portion 61 and extends in the front-and-rear direction. The rear end portion of the lead screw is coupled to a rotation shaft of the bracket motor 62. The ball screw is screwed into the lead screw, and moves in the front-and-rear direction according to rotation of the lead screw. The ball screw is connected to a coupling portion 21 provided at the right end of the printing device 2. The printing device 2 moves in the front-and-rear direction according to the movement of the ball screw in the front-and-rear direction by rotation of the lead screw.

Controller 7

As illustrated in FIG. 3, the controller 7 is interposed between the printing device 2 and the external apparatus 8. The controller 7 outputs data necessary for the printing device 2 to perform printing to the printing device 2. A specific example of data output from the controller 7 to the printing device 2 includes data of a print image. The controller 7 also transmits a signal output from the external apparatus 8 to the printing device 2. Examples of the signals output from the external apparatus 8 include a transport start signal/transport stop signal of the print medium P, a speed signal indicating the transport speed of the print medium P, and a print signal for notifying a printing time for the print medium P.

Electrical Configuration

An electrical configuration of the printing system 1 will be described with reference to FIG. 3. The printing device 2 includes a control unit 2A, a storage unit 2B, a communication interface 2C, the thermal head 24, the first motor 26, the second motor 27, and the third motor 28. The control unit 2A, the storage unit 2B, and the communication interface 2C are equipped in a control board (not illustrated). The control unit 2A is electrically connected to the storage unit 2B, the communication interface 2C, the thermal head 24, the first motor 26, the second motor 27, and the third motor 28. The control unit 2A is configured by a CPU, a RAM, and the like. The storage unit 2B is configured by a hard disk and a non-volatile memory such as a flash memory.

The control unit 2A executes an RRS function printing process (see FIG. 9) described later by reading and executing a program stored in the storage unit 2B. The storage unit 2B stores a program for the control unit 2A to execute the RRS function printing process, a maximum print use length Xp_max in a column described later, and the like. The communication interface 2C is an interface element for communicating between the printing device 2 and the controller 7. The communication interface 2C is connected to the controller 7 via a communication cable.

The thermal head 24 generates heat by energizing heating elements in accordance with a control signal from the control unit 2A. The first motor 26 rotates the supply unit 22 by rotating according to a pulse signal output from the control unit 2A. The second motor 27 rotates the winding unit 23 by rotating according to the pulse signal output from the control unit 2A. The third motor 28 moves the thermal head 24 in the vertical direction by rotating according to the pulse signal output from the control unit 2A.

The bracket 6 includes a bracket motor 62, a sensor 63, and a switch 64. The bracket motor 62 moves the printing device 2 in the front-and-rear direction by rotating according to the pulse signal output from the control unit 2A. The sensor 63 is a contact type sensor capable of detecting a position of the printing device 2 in the front-and-rear direction. The switch 64 is a push button switch to which an instruction for the bracket 6 is input.

The controller 7 includes a control unit 7A, a storage unit 7B, and communication interfaces 7C and 7D. The communication interface 7C is an interface element for communicating between the printing device 2 and the controller 7. The communication interface 7C is connected to the printing device 2 via a communication cable. The communication interface 7D is an interface element for communicating between the external apparatus 8 and the controller 7. The communication interface 7D is connected to the external apparatus 8 via a communication cable. Data required for the printing device 2 to perform printing is stored in the storage unit 7B. The control unit 7A is electrically connected to the storage unit 7B and the communication interfaces 7C and 7D. The control unit 7A reads data required for the printing device 2 to perform printing from the storage unit 7B, and outputs the data to the printing device 2 via the communication interface 7C. The control unit 7A detects a signal received from the external apparatus 8 via the communication interface 7D, and outputs the signal to the printing device 2 via the communication interface 7C.

The external apparatus 8 includes a control unit 8A, an operation panel 8B, and a communication interface 8C. An instruction to the external apparatus 8 is input to the operation panel 8B. The communication interface 8C is an interface element for communicating between the external apparatus 8 and the controller 7. The communication interface 8C is connected to the controller 7 via a communication cable. The control unit 8A is electrically connected to the operation panel 8B and the communication interface 8C. The control unit 8A receives an instruction input to operation panel 8B. The control unit 8A outputs various signals to the controller 7 via the communication interface 8C.

Overview of Print Operation

An overview of a print operation in the printing system 1 will be described with reference to FIGS. 2 and 3. When a print operation is started in the printing system 1, the controller 7 outputs data indicating a print image to the printing device 2. The printing device 2 receives the data and stores the data in the storage unit 2B. According to the start of transport of the print medium P by the external apparatus 8, the transport start signal for starting transport of the print medium P and the speed signal indicating the transport speed of the print medium P are output from the external apparatus 8. The printing device 2 receives the transport start signal and the speed signal via the controller 7.

The print signal notifying the printing time for the print medium P is repeatedly output from the external apparatus 8. The printing device 2 repeatedly receives the print signal via the controller 7. The printing device 2 executes the following print operation according to reception of the print signal. That is, the printing device 2 rotationally drives the first motor 26 and the second motor 27 to rotate the supply roll 90A and the winding roll 90B in the forward rotation direction so that the ink ribbon 9A is transported at a speed synchronized with the transport speed indicated by the speed signal. The ink ribbon 9A moves to the left at a speed synchronized with the print medium P in a transport path between the shafts 92C and 92D. The ink ribbon 9A and the print medium P run in the left direction in parallel to each other. The printing device 2 rotationally drives the third motor 28 to move the thermal head 24 downward from the head position 24A to the head position 24B. The thermal head 24 sandwiches the ink ribbon 9A and the print medium P together with the platen roller Q, and presses the ink ribbon 9A against the print medium P. The heating elements of the thermal head 24 generate heat based on data stored in the storage unit 2B. Ink of the ink ribbon 9A is transferred to the print medium P, and the print image is printed. After printing the print image, the third motor 28 is rotationally driven and the thermal head 24 moves upward from the head position 24B to the head position 24A. The printing device 2 stops rotation of the first motor 26 and the second motor 27. With this configuration, rotation of the supply roll 90A and the winding roll 90B is also stopped, and transport of the ink ribbon 9A is stopped. Printing of the print image is repeatedly performed each time a print signal is received in the printing device 2.

The printing system 1 of this illustrative embodiment has a radial ribbon save (hereinafter also referred to as "RRS") function capable of printing by reducing an unused area in the width direction of the ink ribbon 9A. Specifically, in the printing system 1, the printing device 2 is moved in the width direction (front-and-rear direction) of the ink ribbon 9A before printing for the next one row is started after printing for one row such that the printing device 2 performs printing for the next one row using the unused area in the width direction of the ink ribbon 9A.

Printing Process by RRS Function when Transport Speed of Print Medium P is Constant A printing process by the RRS function (hereinafter also referred to as "RRS function printing process") when the transport speed of the print medium P is constant will be described with reference to FIGS. 4A to 5D. In FIGS. 4A to 5D, an unused area in the ink ribbon 9A is illustrated in black and a used area (print mark) is illustrated in white. An example of the print image is a letter AB in a rectangular frame. In the specific example illustrated in FIGS. 4A to 5D, the right side (lower side in each of FIGS. 4A to 4D) of the ink ribbon 9A is the supply roll 90A side, and the left side (upper side in each of FIGS. 4A to 4D) of the ink ribbon 9A is the winding roll 90B side. The front-and-rear direction of the ink ribbon 9A is referred to as a column, and the horizontal direction is referred to as a row, and the column on the left side (the upper stage in each of FIGS. 4A to 5D) in the ink ribbon 9A is referred to as a first column, and the column on the right side (the lower stage in each of FIGS. 4A to 5D) is referred to as a second column. The row on the frontmost side (left end in the width direction) in the ink ribbon 9A is referred to as a first row, and the rows in order toward the rear side (right end in the width direction) are referred to as the second, third, and fourth rows.

Figure 4A:
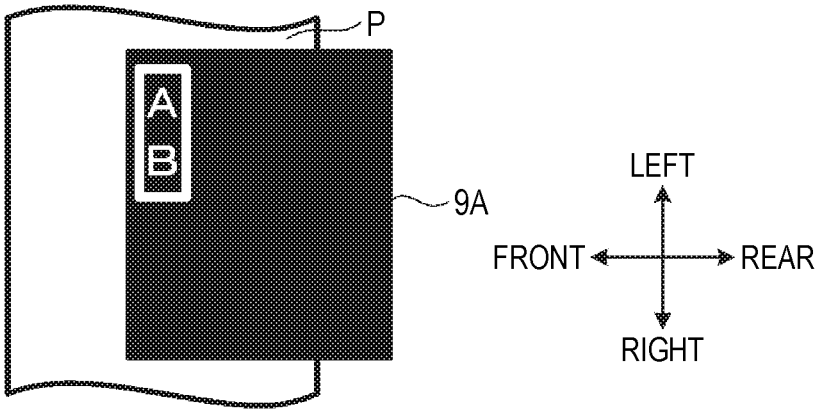
FIGS. 4A to 4D are views illustrating a used area (print mark) of an ink ribbon 9A when a transport speed of a print medium P is constant.

Accordingly, FIG. 4A illustrates a used area where the printing device 2 prints a print image using the first column and the first row of the ink ribbon 9A. FIG. 4D illustrates a state where the printing device 2 prints a print image by using four rows from the first column and the first row to the first column and the fourth row of the ink ribbon 9A. FIG. 5D illustrates a state where the printing device 2 prints a print image by using four rows in each of the first column and the second column of the ink ribbon 9A. The length in the width direction (front-and-rear direction) of the used area of the ink ribbon 9A heated and used in printing for one row is smaller than one-fourth of the length in the width direction of the ink ribbon 9A.

As illustrated in FIG. 4A, when the printing device 2 prints the print image using the first column and the first row of the ink ribbon 9A, in the printing system 1, the following rear preparation control is executed before printing for the next one row is started. That is, the printing device 2 rotationally drives the third motor 28 to move the thermal head 24 upward from the head position 24B to the head position 24A. The printing device 2 rotationally drives the first motor 26 and the second motor 27 to rotate the supply roll 90A and the winding roll 90B in the reverse rotation direction such that the ink ribbon 9A is rewound to the supply roll 90A side by the length in the transport direction of the used area. The bracket 6 moves the printing device 2 forward by a distance K by rotational driving of the bracket motor 62. The distance K is a distance obtained by adding the length in the front-and-rear direction of the used area for one row and the length in the front-and-rear direction for a predetermined margin. With this configuration, the position of the ink ribbon 9A with respect to the print medium P relatively moves forward by the distance K.

Figure 4B:
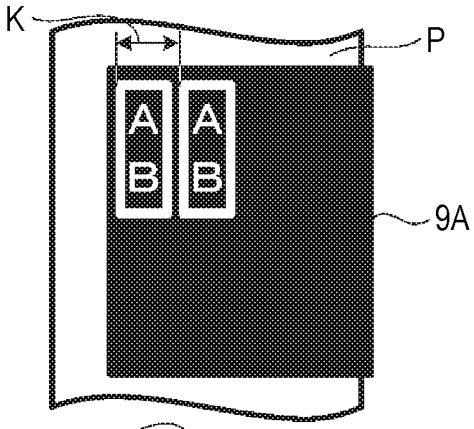
Figure 4C:
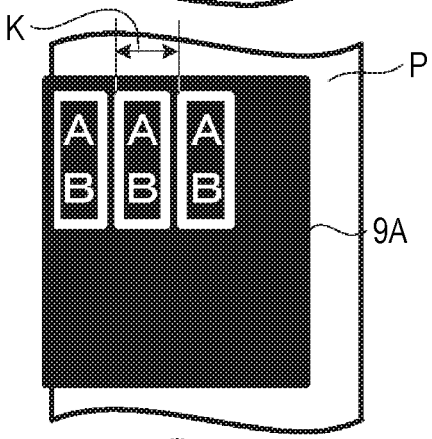
Figure 4D:
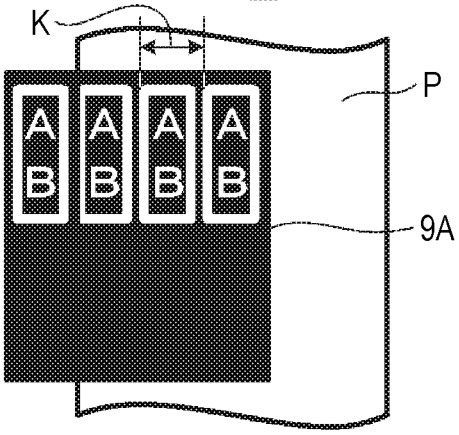

Next, as illustrated in FIG. 4B, when the printing device 2 receives the print signal, the printing device 2 executes printing for one row using the unused area of the first column and the second row of the ink ribbon 9A in the same column as one row printed on the print medium P. Thereafter, in the printing system 1, the rear preparation control is executed to relatively move the position of the ink ribbon 9A with respect to the print medium P forward by the distance K. Similarly to above, as illustrated in FIG. 4C, the printing device 2 executes printing for one row using the unused area of the first column and the third row of the ink ribbon 9A. Next, as illustrated in FIG. 4D, the printing device 2 executes printing for one row using the unused area in the first column and the fourth row. With this configuration, the printing device 2 executes printing for four rows arranged in the transport direction with respect to the print medium P using four unused areas arranged in the width direction of the ink ribbon 9A from the front side in order.

In the printing system 1, as illustrated in FIG. 4D, when printing for four rows in the first column is completed, an unused area in which printing for one row is possible does not exist in the rear of the used area in the ink ribbon 9A. In this case, in the printing system 1, the following normal preparation control is executed before printing for the next one row is started. That is, the printing device 2 rotationally drives the third motor 28 to move the thermal head 24 upward from the head position 24B to the head position 24A. The printing device 2 rotationally drives the first motor 26 and the second motor 27 to rotate the supply roll 90A and the winding roll 90B in the forward rotation direction, thereby causing the ink ribbon 9A to run parallel to the print medium P. The bracket 6 maintains the position in the front-and-rear direction of the printing device 2 without rotationally driving the bracket motor 62.

Figure 5A:
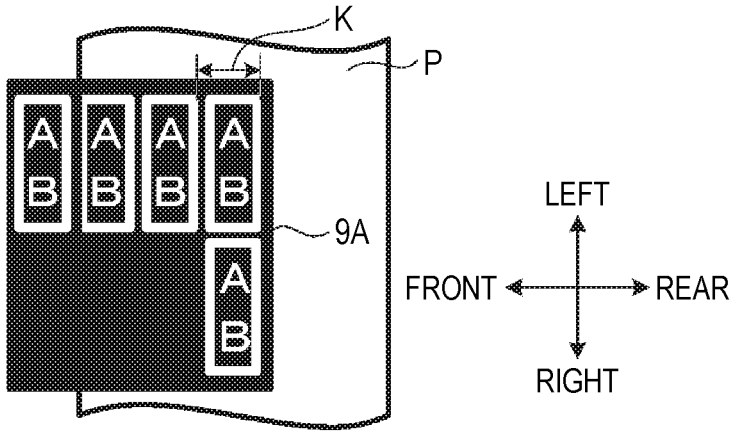
FIGS. 5A to 5D are views illustrating another used area (print mark) of the ink ribbon 9A when the transport speed of the print medium P is constant.

Next, when the print signal is received, as illustrated in FIG. 5A, the printing device 2 executes printing for one row using the second column and the fourth row of the ink ribbon 9A. In this case, in the printing system 1, the front preparation control is executed before printing for the next one row is started. The front preparation control is basically the same as the rear preparation control, except that the bracket 6 moves the printing device 2 rearward by the distance K by rotational driving of the bracket motor 62. With this configuration, the position of the ink ribbon 9A with respect to the print medium P is relatively moved rearward by the distance K.

Figure 5B:
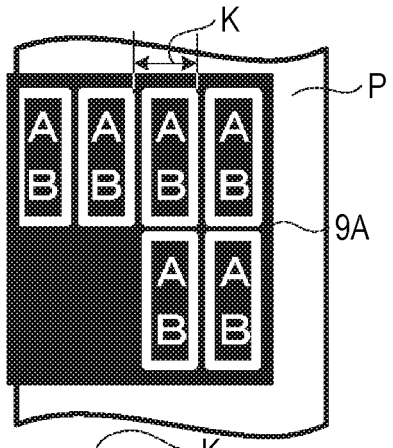
Figure 5C:
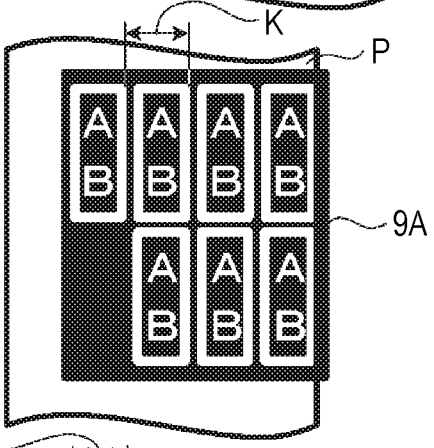
Figure 5D:
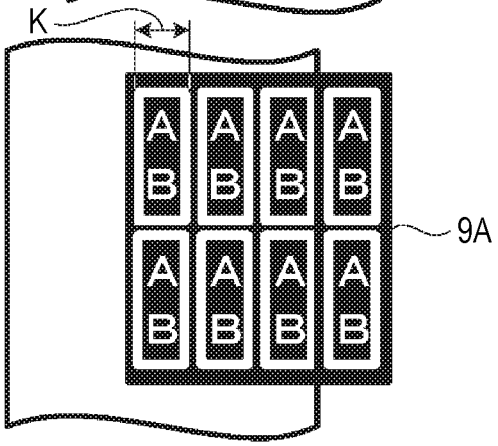

Next, when the print signal is received, as illustrated in FIG. 5B, the printing device 2 executes printing for one row using the second column and the third row of the ink ribbon 9A. Thereafter, in the printing system 1, the front preparation control is executed, and the position of the ink ribbon 9A with respect to the print medium P is relatively moved rearward by a distance K. Similarly to above, as illustrated in FIG. 5C, the printing device 2 executes printing for one row using the second column and the second row of the ink ribbon 9A. As illustrated in FIG. 5D, the printing device 2 executes printing for one row using the second column and the first row of the ink ribbon 9A. With this configuration, the printing device 2 can execute printing for four rows arranged in the transport direction on the print medium P, using four unused areas arranged in the width direction of the ink ribbon 9A from the rear side in order.

Figure 6:
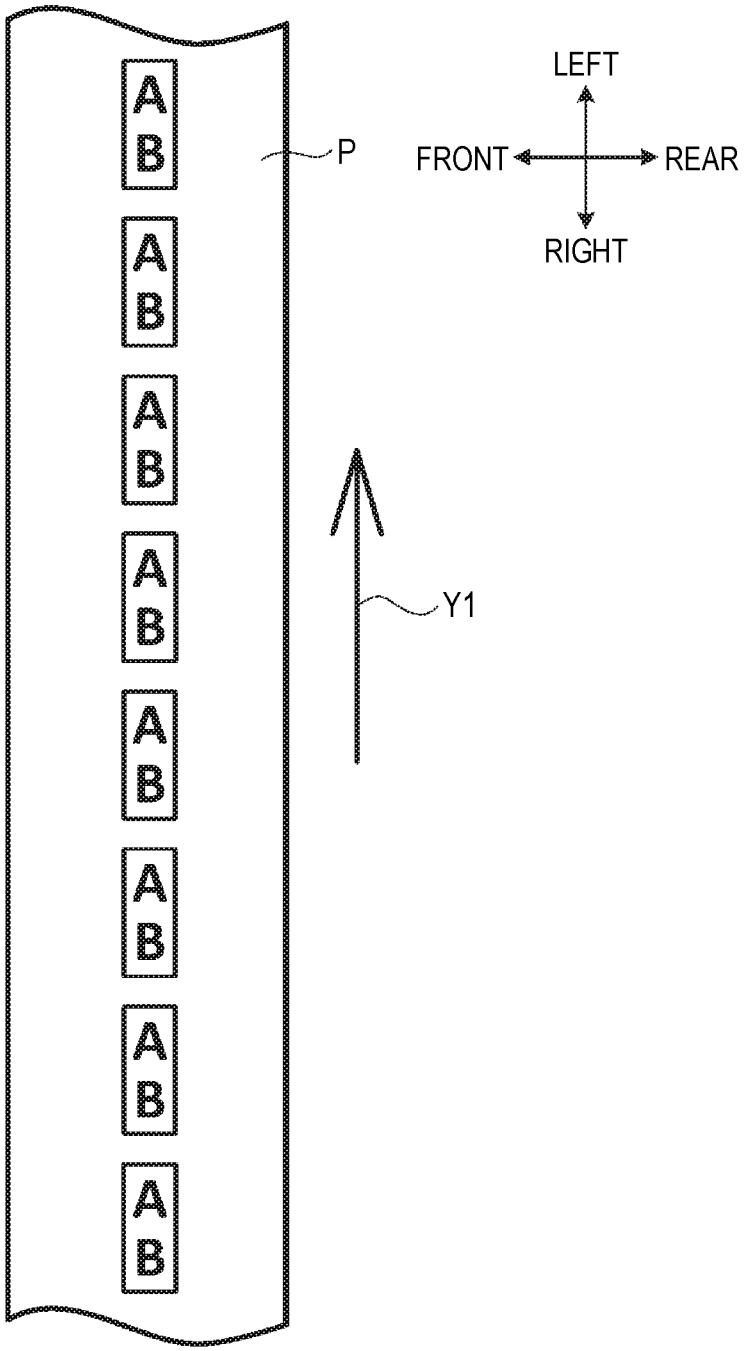
FIG. 6 is a view illustrating a print state of a print image on the print medium P when the transport speed of the print medium P is constant.

As illustrated in FIG. 5D, when printing for four rows is completed, an unused area in which printing for one row is possible does not exist in front of the used area in the ink ribbon 9A. In this case, in the printing system 1, the normal preparation control is executed before printing for the next one row is started. When the print signal is received, the printing device 2 executes printing for one row with respect to the used area illustrated in FIG. 5D similarly as in FIG. 4A using an unused area located upstream (rightward) in the transport direction of the ink ribbon 9A. In the printing system 1, the print operation illustrated in FIGS. 4A to 5D is repeatedly executed so that the unused areas in the ink ribbon 9A are used so as to meander, and as illustrated in FIG. 6, eight print images arranged in the direction of the arrow Y1 are printed on the print medium P.

According to the stop of the transport of the print medium P by the external apparatus 8, a transport stop signal for stopping transport of the print medium P is output from the external apparatus 8. The printing device 2 receives the transport stop signal via the controller 7. The print operation in the printing system 1 is stopped.

Printing Process by RRS Function of Related Art when Transport Speed of Print Medium P is Variable With reference to FIG. 7, a use state of the ink ribbon 9A when the printing device 2 performs the printing process by the RRS function of the related art on the print medium P whose transport speed is variable will be described. In the example illustrated in FIG. 7, similarly to the example illustrated in FIG. 5D, a state in which the printing device 2 performs printing using the first column and the first row to the second column and the fourth row of the ink ribbon 9A is illustrated. In the example illustrated in FIG. 7, the order of the used areas of the ink ribbon 9A is the same as in the example illustrated in FIGS. 4A to 5D, and as indicated by the arrows, printing is performed using the first column and the first row to the first column and the fourth row of the ink ribbon 9A in order, and then printing is performed using the second column and the fourth row to the second column and the first row in order. In the following, the description of the same portions of the print operation as the examples illustrated in FIGS. 4A to 5D will be omitted, and different portions will be described.

Figure 7:
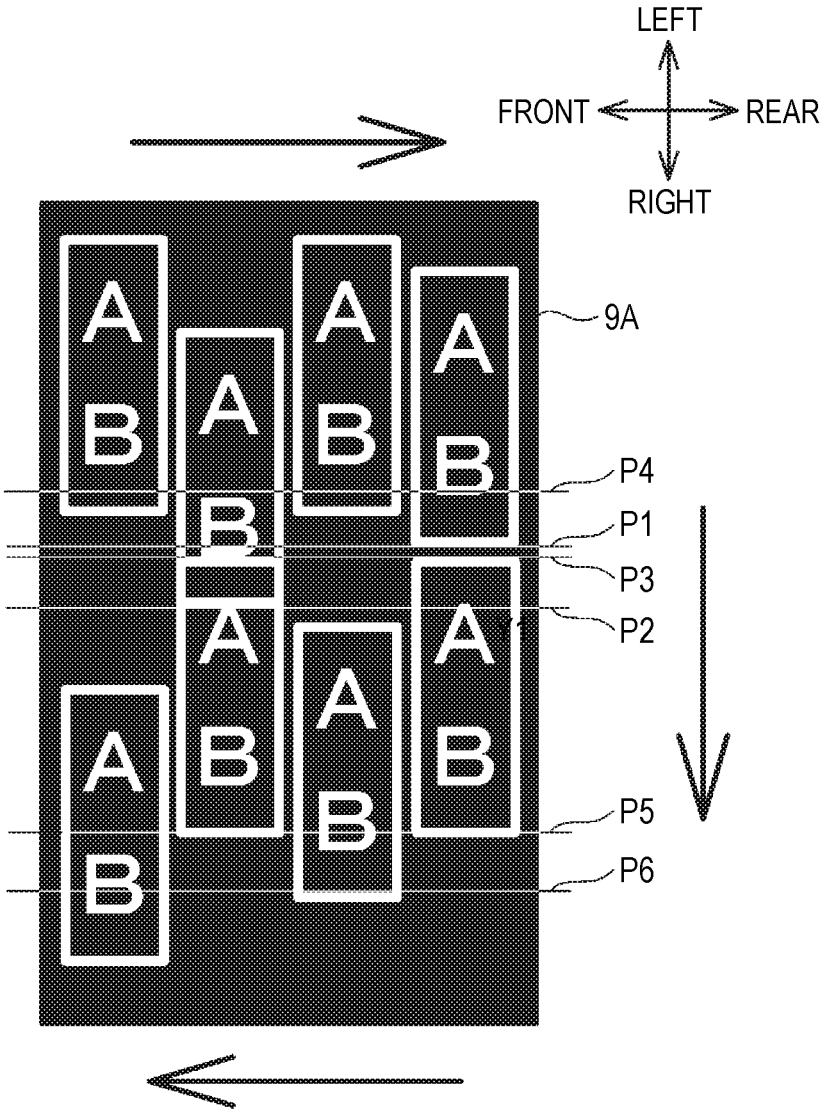
FIG. 7 is a view illustrating a use state of the ink ribbon 9A when the printing device 2 performs a print operation of the related art on the print medium P whose transport speed is variable.

In the example illustrated in FIG. 7, as an example, the transport speed of the print medium P during printing using the first column and the second row of the ink ribbon 9A is slower than the transport speed of the print medium P during printing using the first column and the first row of the ink ribbon 9A. Accordingly, a transport length to the print start position of the ink ribbon 9A during printing using the first column and the second row is longer than the transport length during printing using the first column and the first row. In this case, the used area of the first column and the second row of the ink ribbon 9A is shifted to the right from the used area of the first column and the first row. The transport speed of the print medium P during printing using the first column and the third row is the same as the transport speed of the print medium P during printing using the first column and the first row. Accordingly, the used area of the first column and the third row of the ink ribbon 9A is at the same position in the horizontal direction as the used area using the first column and the first row. The transport speed of the print medium P during printing using the first column and the fourth row is slower than the transport speed of the print medium P during printing using the first column and the third row and is faster than the transport speed of the print medium P during printing using the first column and the second row. Accordingly, the used area of the first column and the fourth row is shifted to the right from the used area of the first column and the third row, and is shifted to the left from the used area of the first column and the second row.

In the example illustrated in FIG. 7, a position P1 in the horizontal direction of the ink ribbon 9A is a print completion position using the first column and the fourth row. A position P2 is a ribbon deceleration completion position of the ink ribbon 9A of the first column and the fourth row. Accordingly, a planned printing start position of the second column is a position P3 which is spaced apart from the position P1 by a predetermined distance so as not to be caught by the position P1. Accordingly, the length by which the ink ribbon 9A is rewound for printing of the second column is the sum of the length necessary for accelerating the ink ribbon 9A for printing of the second column and the length between the position P1 and the position P2. As one example, the position at which the ink ribbon 9A is rewound for printing of the second column is a position P4. A position P5 is a print completion position using the second column and the fourth row. A position P6 is a ribbon deceleration completion position of the ink ribbon 9A for printing using the second column and the fourth row.

Figure 8:
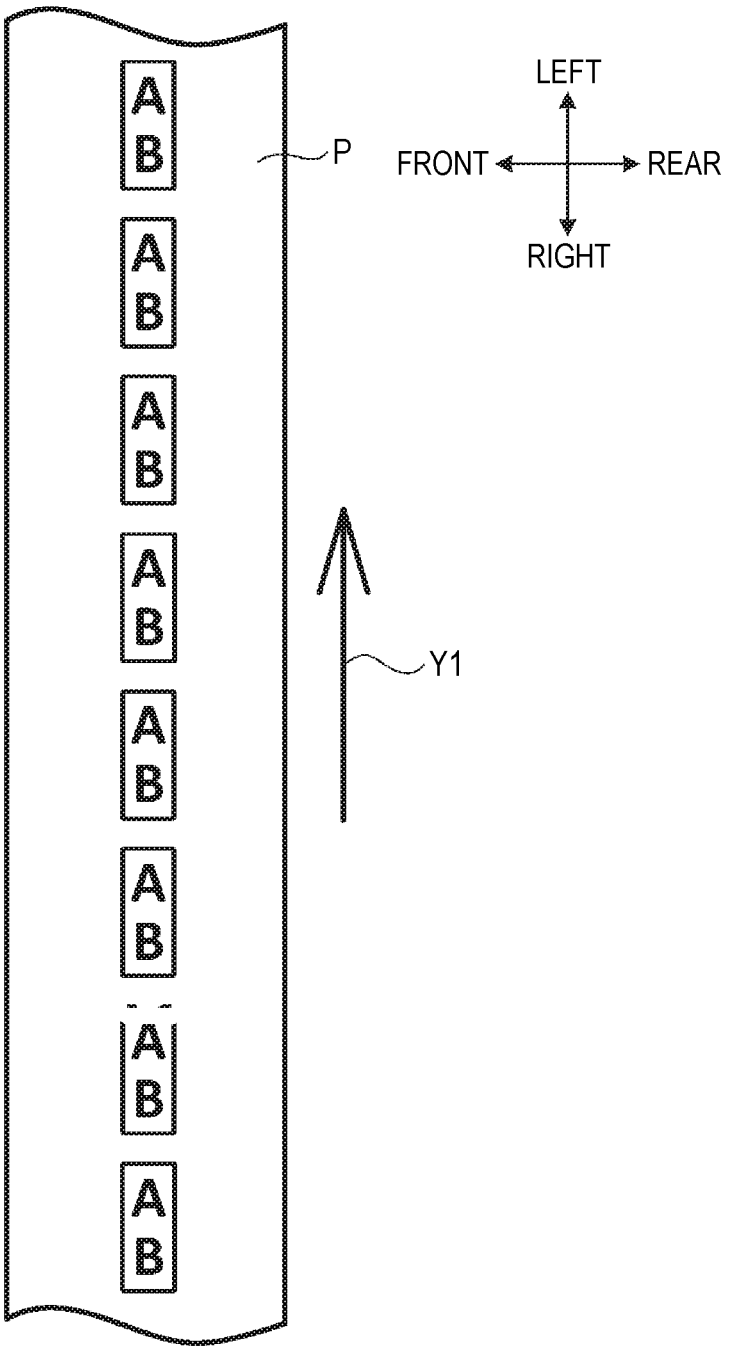
FIG. 8 is a view illustrating a print state of a print image on the print medium P when the transport speed of the print medium P is variable.

In the example illustrated in FIG. 7, the transport speed of the print medium P during printing using the second column and the third row of the ink ribbon 9A is slower than the transport speed of the print medium P during printing using the second column and the fourth row of the ink ribbon 9A. Accordingly, the transport length to the print start position of the ink ribbon 9A during printing using the second column and the third row is longer than the transport length during printing using the second column and the fourth row. In this case, the used area of the second column and the third row of the ink ribbon 9A is shifted to the right from the used area of the second column and the fourth row. The transport speed of the print medium P during printing using the second column and the second row is the same as the transport speed of the print medium P during printing using the second column and the fourth row. Accordingly, the used area of the second column and the second row of the ink ribbon 9A is at the same position as the used area using the second column and the fourth row in the horizontal direction. Accordingly, a part of the used area of the second column and the second row overlaps the used area of the first column and the second row. In this case, as illustrated in FIG. 8, a blur occurs in a print image printed on the print medium P using the second column and the second row of the ink ribbon 9A.

Figure 9:
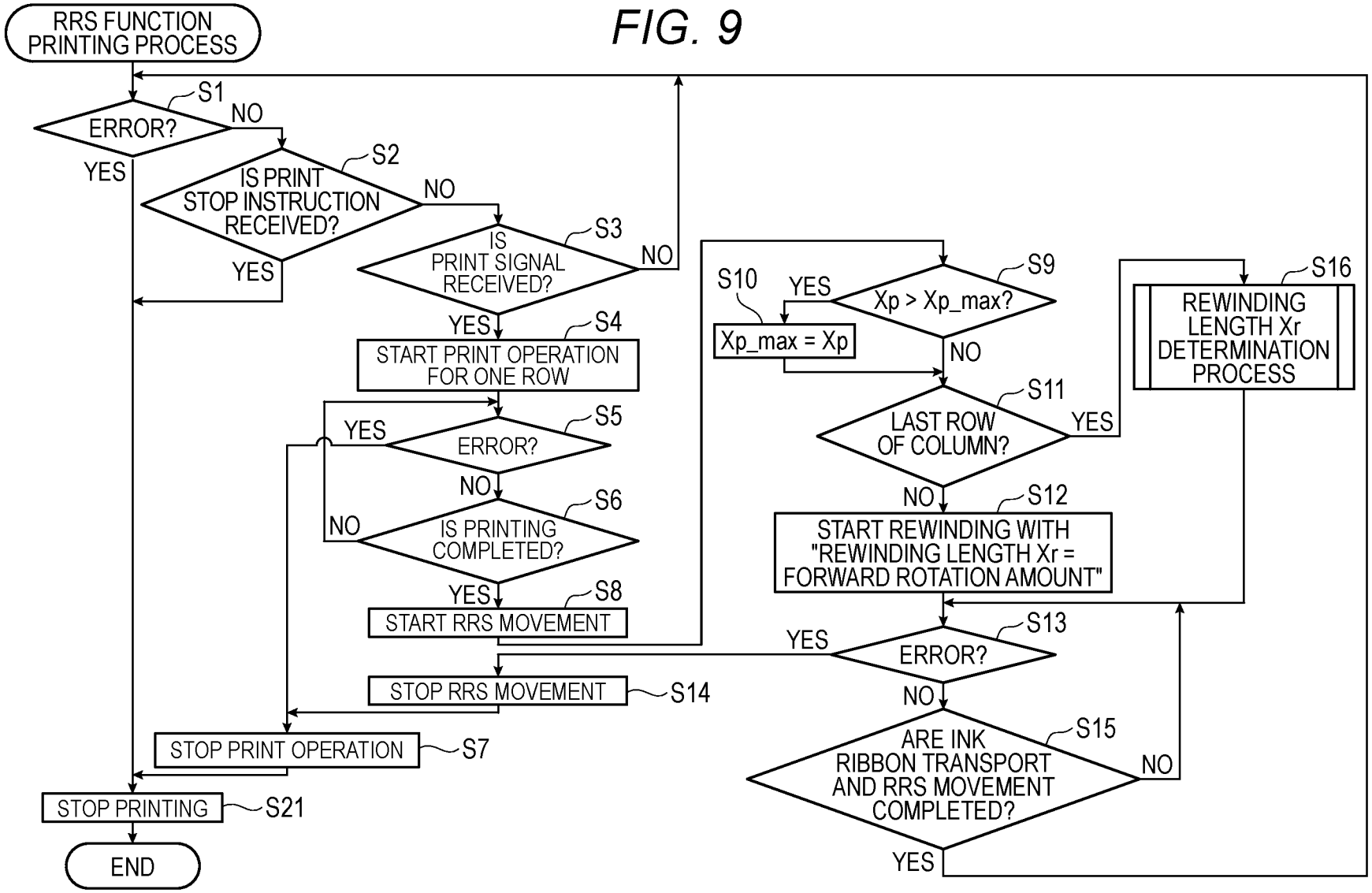
FIG. 9 is a flowchart of an RRS function printing process according to an illustrative embodiment.

Printing Process by RRS Function of this Illustrative Embodiment when Transport Speed of Print Medium P is Variable A printing process by the RRS function of this illustrative embodiment of the printing system 1 will be described in detail with reference to FIGS. 9 to 13D. As illustrated in FIG. 9, when the printing device 2 is powered on, the control unit 2A of the printing device 2 reads out and executes a program of the RRS function printing process stored in the storage unit 2B. The control unit 2A determines whether an error has occurred in a function of the printing device 2 (S1). An example of an error is a case where the cassette 9 is not attached to the cassette attachment unit 20 and where the control unit 2A receives a signal indicating that the cassette 9 is not attached from a cassette sensor (not illustrated). When it is determined that an error has occurred (YES in S1), the control unit 2A stops printing (S21) and ends the printing process. When it is not determined that an error has occurred (NO in S1), the control unit 2A determines whether a print stop instruction is received via the controller 7 (S2). When it is determined that the print stop instruction is received (YES in S2), the control unit 2A stops the printing (S21), and ends the printing process. When it is not determined that the print stop instruction is received (NO in S2), the control unit 2A determines whether a print signal instructing start of printing for one row is received via the controller 7 (S3). When it is determined that the print signal is received via the controller 7 (YES in S3), the control unit 2A starts the print operation for one row (S4).

Specifically, the controller 7 outputs print data indicating a print image to the printing device 2. The control unit 2A receives the print data and stores the print data in storage unit 2B. According to the start of transport of the print medium P by the external apparatus 8, a transport start signal for starting transport of the print medium P and a speed signal indicating the transport speed of the print medium P are output from the external apparatus 8. The control unit 2A receives the transport start signal and the speed signal via the controller 7.

A print signal instructing start of printing for one row on the print medium P is output from the external apparatus 8. The control unit 2A receives the print signal via the controller 7 (YES in S3). The printing device 2 executes the following print operation according to reception of the print signal (S4). That is, the control unit 2A rotationally drives the first motor 26 and the second motor 27 to rotate the supply roll 90A and the winding roll 90B in the forward rotation direction so that the ink ribbon 9A is transported at a speed synchronized with the transport speed indicated by the speed signal. The ink ribbon 9A moves to the left at a speed synchronized with the print medium P in the transport path between the shafts 92C and 92D. The ink ribbon 9A and the print medium P run in the left direction in parallel to each other. The printing device 2 rotationally drives the third motor 28 to move the thermal head 24 downward from the head position 24A to the head position 24B. The thermal head 24 sandwiches the ink ribbon 9A and the print medium P together with the platen roller Q, and presses the ink ribbon 9A against the print medium P. The heating elements of the thermal head 24 generate heat based on the print data stored in the storage unit 2B. Ink of the ink ribbon 9A is transferred to the print medium P, and a print image is printed (S4).

The control unit 2A determines whether an error has occurred in the print operation (S5). An example of the error is a case where the cassette 9 is removed from the cassette attachment unit 20, the ink ribbon 9A is cut, or the ink ribbon 9A cannot be transported, and the like. When it is determined that an error has occurred in the print operation (YES in S5), the controller 2A stops the first motor 26, the second motor 27, and the thermal head 24 to stop the print operation (S7). When it is not determined that an error has occurred in the print operation (NO in S5), the control unit 2A determines whether the printing is completed (S6). When printing for one row is completed, the control unit 2A determines that the printing is completed (YES in S6). That is, when the ink ribbon 9A is transported by a transport length X (hereinafter, referred to as a "forward rotation amount") obtained by summing an expected acceleration length Xu, a print use length Xp, and a deceleration length Xd, the control unit 2A determines that the printing is completed (YES in S6). The expected acceleration length Xu is a length by which the ink ribbon 9A is transported until the transport of the ink ribbon 9A is started and printing with the thermal head 24 is started. The print use length Xp is a length by which the ink ribbon 9A is transported until the transport of the ink ribbon 9A is started and the printing with the thermal head 24 is ended. The deceleration length Xd is a length until the printing with the thermal head 24 is completed and the transport of the ink ribbon 9A is stopped. That is, when the print position is not reached after being transported by the expected acceleration length Xu, the transport length becomes long, and when the printing position is reached after being transported by the expected acceleration length Xu, the transport length becomes short. This difference causes variations in the print start position (left and right) for each row in the RRS function printing process.

Figure 11A:
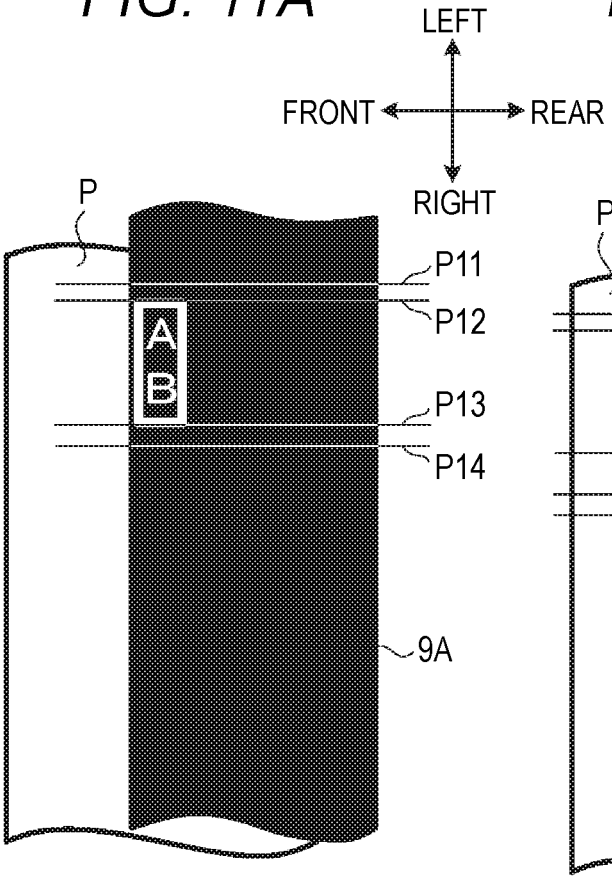
FIGS. 11A to 11D are views illustrating a used area (print mark) of the ink ribbon 9A when the transport speed of the print medium P is variable.

FIG. 11A illustrates the ink ribbon 9A subjected to printing using an area of the first column and the first row. A position P11 is an acceleration start position of the ink ribbon 9A, and a position P12 is a printing start position. A position P13 is a print completion position, and a position P14 is a deceleration completion position of the ink ribbon 9A. The length between the position P11 and the position P12 is the expected acceleration length Xu. The length between the position P11 and the position P13 is the print use length Xp. The length between the position P13 and the position P14 is the deceleration length Xd. The length between the position P11 and the position P14 is the transport length X (forward rotation amount).

When it is not determined that the printing is completed (NO in S6), the control unit 2A returns the process to S5. When it is determined that the printing is completed (YES in S6), the control unit 2A starts movement of the printing device 2 by the RRS function (S8). The third motor 28 is rotationally driven and the thermal head 24 moves upward from the head position 24B to the head position 24A. The bracket motor 62 is rotationally driven to move the printing device 2 in the front-and-rear direction. Next, the control unit 2A determines whether the print use length Xp is larger than the maximum print use length Xp_max in a column (S9). The print use length Xp=X−Xd is satisfied. The maximum print use length Xp_max in a column is stored in the storage unit 2B. When a first row of each column of the ink ribbon 9A is used and printed, a value of the maximum print use length Xp_max is reset to "0". Accordingly, the print use length Xp when the printing using an area of the first column and the first row illustrated in FIG. 11A is completed is longer than the maximum print use length Xp_max. The control unit 2A determines that Xp>Xp_max is satisfied (YES in S9). The control unit 2A stores the print use length Xp when printing using the area of the first column and the first row is completed in the storage unit 2B as Xp_max, by setting Xp_max=Xp (S10). An example of Xp_max stored in the storage unit 2B is the number of steps for transporting the ink ribbon 9A by the print use length Xp when the first motor 26 and the second motor 27 are stepping motors.

Next, the control unit 2A determines whether the row used for printing is the last row of the column (S11). As one example, the control unit 2A makes the determination of S11 based on the number of steps of driving the bracket motor 62 or a detection signal from the sensor 63. In a determination process of S9, when it is not determined that Xp>Xp_max is satisfied (NO in S9), the control unit 2A causes the process to proceed to S11.

When it is not determined that the row used for printing is the last row of the column (NO in S11), the control unit 2A starts rewinding the ink ribbon 9A by setting a rewinding length Xr of the ink ribbon 9A as the forward rotation amount (S12). That is, the control unit 2A rotationally drives the first motor 26 and the second motor 27 to rotate the supply roll 90A and the winding roll 90B in the reverse rotation direction, thereby starting rewinding by the transport length X (forward rotation amount) transported by processes of S4 to S6 (S12). In the example illustrated in FIG. 11A, the ink ribbon 9A is rewound by the length (forward rotation amount) of P11 to P14. When it is determined that an error has occurred in the rewinding operation (YES in S13), the controller 2A stops the movement of the printing device 2 by the RRS function (S14). Next, the control unit 2A stops the first motor 26, the second motor 27, and the thermal head 24 to stop the print operation (S7). An example of the error is a case where the ink ribbon 9A cannot be transported, and the like.

Figure 11B:
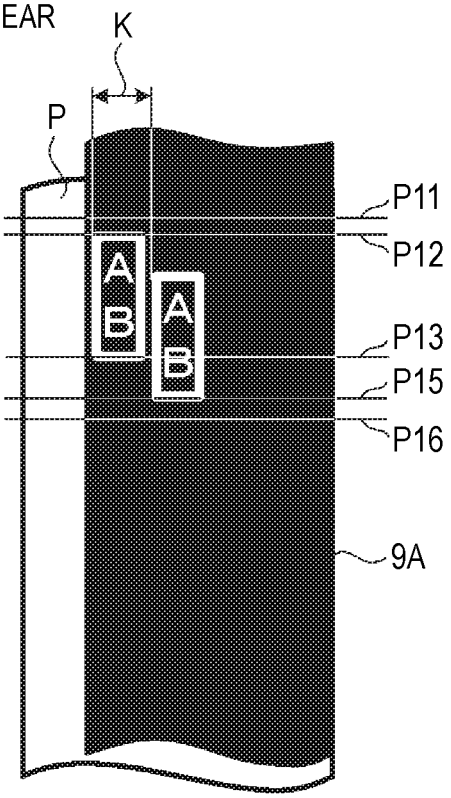

When it is not determined that an error has occurred in the rewinding operation (NO in S13), the control unit 2A determines whether the transport of the ink ribbon 9A and the movement of the printing device 2 by the RRS function are completed (S15). The control unit 2A makes the determination of S15 based on the number of pulses by which the first motor 26, the second motor 27, and the bracket motor 62 have been driven and the signal from the sensor 63. When it is determined that the determination result in the determination process of S15 is YES, the control unit 2A returns the process to S1. The control unit 2A performs the processes of S1 to S6 in the same manner as described above, and performs printing using the area of the first column and the second row of the ink ribbon 9A illustrated in FIG. 11B. When the speed signal received via the controller 7 by the control unit 2A is slower than printing using the area of the first column and the first row of the ink ribbon 9A, as illustrated in FIG. 11B, the used area of the first column and the second row is shifted to the right from the used area of the first column and the first row. A position P15 is the print completion position of the first column and the second row, and a position P16 is the deceleration completion position of the ink ribbon 9A. Accordingly, the print use length Xp (length between the position P11 and the position P15) of the used area of the first column and the second row is longer than the print use length Xp (length between the position P11 and the position P13) of the used area of the first column and the first row.

When it is determined that the printing is completed (YES in S6), the control unit 2A starts movement of the printing device 2 by the RRS function similarly to above (S8). Next, the control unit 2A determines whether the print use length Xp is larger than the maximum print use length Xp_max in a column (S9). Since the print use length Xp of the used area of the first column and the second row is longer than the print use length Xp of the used area of the first column and the first row stored as Xp_max in the storage unit 2B, the control unit 2A determines that Xp>Xp_max is satisfied (YES in S9). The control unit 2A stores the print use length Xp when the printing of the first column and the second row is completed as Xp_max in the storage unit 2B (S10).

Next, the control unit 2A determines whether the row used for printing is the last row of the column (S11). Since the first column and the second row is not the last row of the column, the control unit 2A does not determine that the printed row is the last row of the column (NO in S11). The control unit 2A starts rewinding by setting the rewinding length Xr of the ink ribbon 9A as the forward rotation amount (S12). Since the transport length X (forward rotation amount) of the first column and the second row is longer than the transport length X (forward rotation amount) of the first column and the first row, the rewinding amount in the process of S12 becomes longer.

Figure 11C:
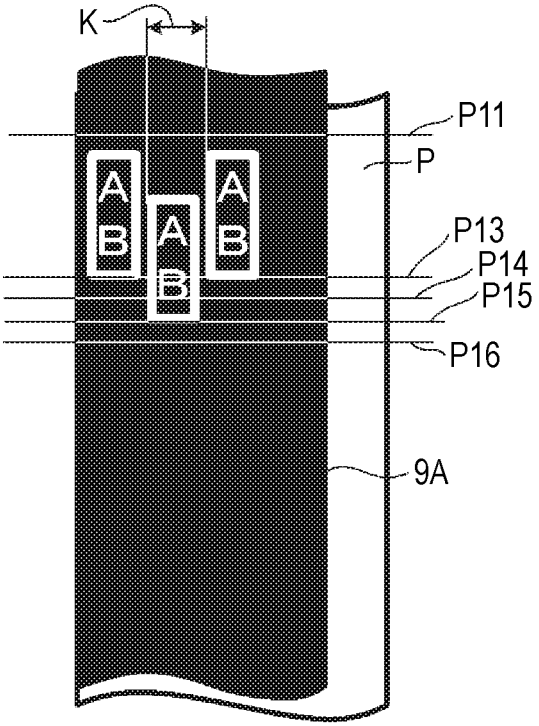

When it is not determined that an error has occurred in the rewinding operation (NO in S13), and when it is determined that the transport of the ink ribbon 9A and the movement of the RRS are completed (YES in S15), the control unit 2A returns the process to S1. The control unit 2A performs the processes of S1 to S6 in the same manner as described above, and performs printing using the area of the first column and the third row of the ink ribbon 9A illustrated in FIG. 11C. When the speed signal received via the controller 7 by the controller 2A is the same as printing using the area of the first column and the first row of the ink ribbon 9A, as illustrated in FIG. 11C, in the horizontal direction of the ink ribbon 9A, the area is located at the same position as the used area of the first column and the first row. Accordingly, the print use length Xp (length between the position P11 and the position P13) of the used area of the first column and the third row is shorter than the print use length Xp (length between the position P11 and the position P15) of the used area of the first column and the second row.

When it is determined that the printing is completed (YES in S6), the control unit 2A starts movement of the printing device 2 by the RRS function, similarly to above (S8). Next, the control unit 2A determines whether the print use length Xp is larger than the maximum print use length Xp_max in a column (S9). The print use length Xp of the used area of the first column and the third row is shorter than the print use length Xp of the used area of the first column and the second row stored as Xp_max in the storage unit 2B. Accordingly, the control unit 2A does not determine that Xp>Xp_max is satisfied (NO in S9). The control unit 2A causes the process to proceed to S11.

Next, the control unit 2A determines whether the row used for printing is the last row of the column (S11). Since the first column and the third row is not the last row of the column, the control unit 2A does not determine that the printed row is the last row of the column (NO in S11). The control unit 2A starts rewinding by setting the rewinding length Xr of the ink ribbon 9A as the forward rotation amount (S12). The transport length X (forward rotation amount) of the first column and the third row is the same as the transport length X (forward rotation amount) of the first column and the first row. Accordingly, the length between the position P11 and the position P14 is rewound.

Figure 11D:
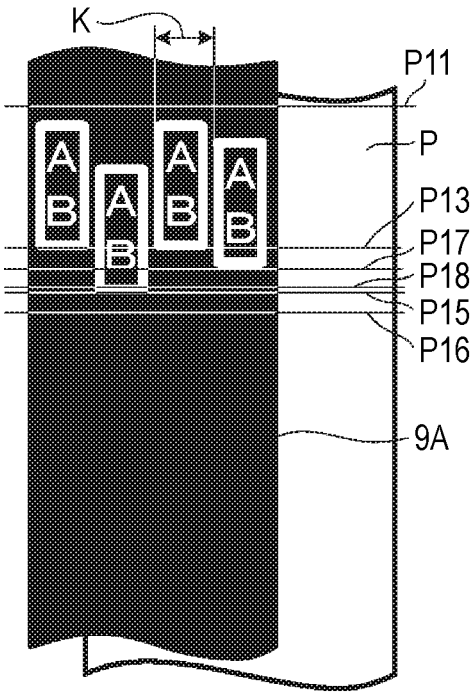

When it is not determined that an error has occurred in the rewinding operation (NO in S13), and when it is determined that the transport of the ink ribbon 9A and the movement of the RRS are completed (YES in S15), the control unit 2A returns the process to S1. The control unit 2A performs the processes of S1 to S6 in the same manner as described above, and performs printing using the area of the first column and the fourth row of the ink ribbon 9A illustrated in FIG. 11D. A position P17 is the print completion position, and a position P18 is the deceleration completion position of the ink ribbon 9A. When the speed signal received via the controller 7 by the control unit 2A is slower than printing using the area of the first column and the third row of the ink ribbon 9A, but faster than printing using the area of the first column and the second row, as illustrated in FIG. 11D, in the horizontal direction of the ink ribbon 9A, the used area of printing using the first column and the fourth row is shifted to the right from the used area of the first column and the third row, but is shifted to the left from the used area of the first column and the second row. Accordingly, the print use length Xp (length between the position P11 and the position P17) of the used area of the first column and the fourth row longer than the print use length Xp (length between the position P11 and the position P13) of the used area of the first column and the third row, and shorter than the print use length Xp (length between the position P11 and the position P15) of the used area of the first column and the second row.

When it is determined that the printing is completed (YES in S6), the control unit 2A starts movement of the printing device 2 by the RRS function, similarly to above (S8). Next, the control unit 2A determines whether the print use length Xp is larger than the maximum print use length Xp_max in a column (S9). Since the print use length Xp of the used area of the first column and the fourth row is shorter than the print use length Xp of the used area of the first column and the second row stored as Xp_max in the storage unit 2B, the control unit 2A does not determine that Xp>Xp_max is satisfied (NO in S9). The control unit 2A causes the process to proceed to S11.

Next, the control unit 2A determines whether the row used for printing is the last row of the column (S11). Since the first column and the fourth row is the last row of the column, the control unit 2A determines that the printed row is the last row of the column (YES in S11), and determines the rewinding length Xr (S16). In the next printing, a column to be subjected to printing is switched from the first column to the second column. At the column switching timing, the control unit 2A determines the rewinding length Xr which optimizes the spacing with the next column and rewinds the ink ribbon by the rewinding length Xr.

Figure 10:
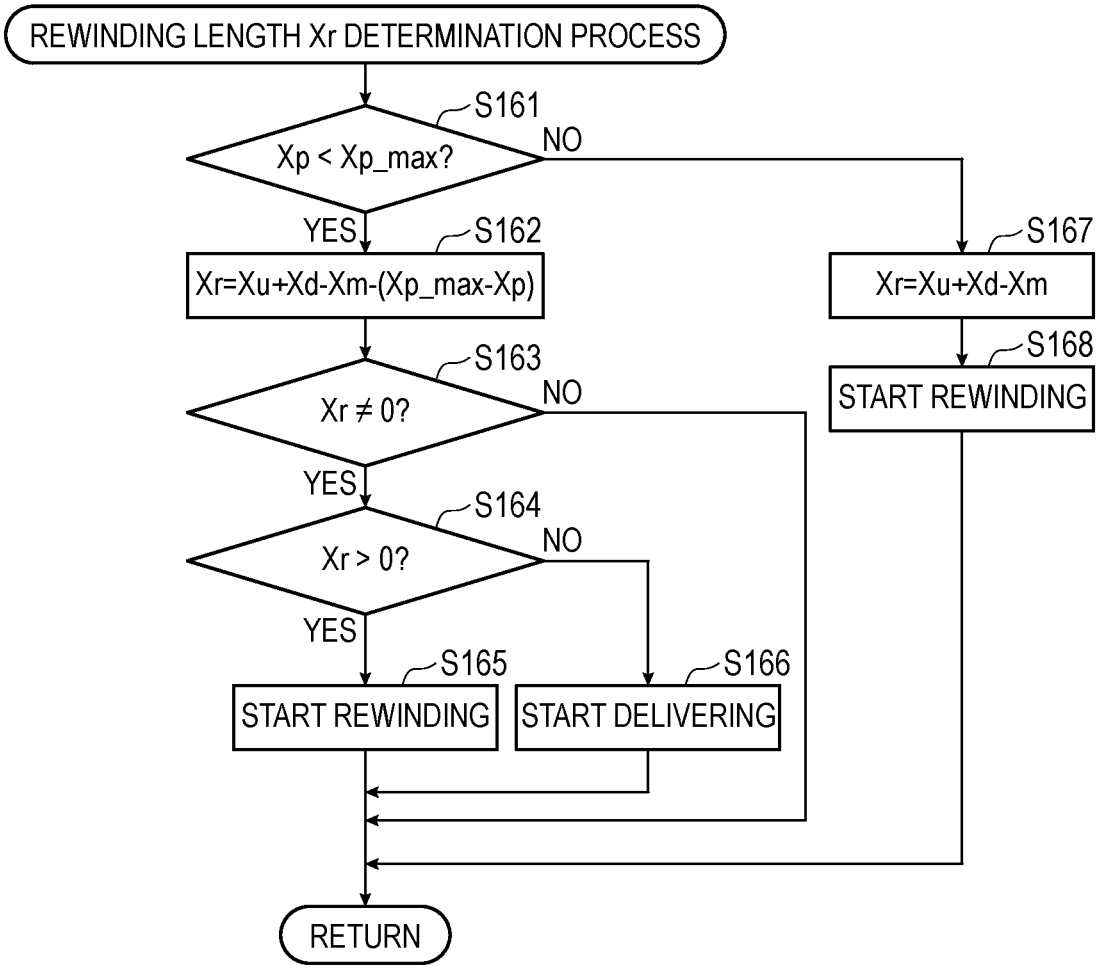
FIG. 10 is a subroutine of a rewinding length Xr determination process.

A process (S16) for calculating the rewinding length Xr will be described with reference to a subroutine of FIG. 10. Hereinafter, each parameter is defined as follows. An expected ribbon acceleration length, which is the length of the ink ribbon 9A from when the ink ribbon 9A is started to be transported from the stop position to when the printing is started, is "Xu", a ribbon deceleration length, which is the transport length of the ink ribbon 9A from when printing is ended to when the transport of the ink ribbon 9A stops, is "Xd", and the previous print use length is "Xp", where Xp is the total length of Xu and the length of the print image in the horizontal direction. The maximum print use length in a column is "Xp_max", and an actual ribbon transport length is X. X is the total length of Xu, Xd, and the length of the print image in the horizontal direction. Accordingly, the print use length Xp=X−Xd is satisfied. The rewinding length is "Xr", and the spacing between the used areas (print marks) in the left rear direction is "Xm (for example, 1 mm in fixed value)". In the example illustrated in FIG. 12A, Xu is a length between the position P21 and the position P22, and Xd is a length between the position P23 and the position P24. In order to perform printing using the second column and the fourth row of the ink ribbon, the minimum length required for rewinding is Xu+Xd−Xm. In this illustrative embodiment, the value of each parameter is, for example, the number of steps for driving the first motor 26 and the second motor 27, and calculations of S162 and S167 are also performed based on the number of steps.

First, the control unit 2A determines whether Xp<Xp_max is satisfied (S161). Since the previous print use length Xp is the print use length (length between the position P11 and the position P17) of the first column and the fourth row as illustrated in FIG. 11D, the print use length Xp is shorter than Xp_max (print use length of the first column and the second row, that is, length between the position P11 and the position P15) stored in the storage unit 2B. Accordingly, the control unit 2A determines that Xp<Xp_max is satisfied (YES in S161). Next, the control unit 2A calculates the rewinding length Xr as follows. Xr=Xu+Xd−Xm−(Xp_max−Xp) (S162). The reason why (Xp_max−Xp) is subtracted from (Xu+Xd−Xm) is because, if the difference from Xp_max, which is longer than the previous print use length Xp, is not subtracted from the rewinding length Xr, the used area of the ink ribbon 9A can be overlapped, as illustrated in FIG. 7. Accordingly, as illustrated in FIG. 8, there is a possibility that printing may be blurred. After calculating the rewinding length Xr in the process of S162, the control unit 2A resets the value of Xp_max stored in the storage unit 2B.

The control unit 2A determines whether Xr is not 0 (S163). When it is not determined that Xr is not 0 (NO in S163), that is, if Xr=0 is satisfied, the control unit 2A does not need to rewind or deliver the ink ribbon 9A, and thus the control unit 2A causes the process to proceed to S13 of FIG. 9. When it is determined that Xr is not 0 (YES in S163), the controller 2A determines whether Xr is greater than 0 (S164). When it is determined that Xr is greater than 0 (YES in S164), the control unit 2A starts rewinding the ink ribbon 9A toward the supply unit 22 side by Xr (S165), and causes the process to proceed to S13 of FIG. 9. When it is not determined that Xr is larger than 0 (NO in S164), the control unit 2A starts delivering the ink ribbon 9A toward the winding unit 23 side by Xr (S166), and causes the process to proceed to S13 of FIG. 9.

When it is not determined that Xp<Xp_max is satisfied (NO in S161), that is, if Xp Xp_max is satisfied, the control unit 2A sets the rewinding length Xr to Xr=Xu+Xd−Xm (S167). After calculating the rewinding length Xr in the process of S167, the control unit 2A resets the value of Xp_max stored in the storage unit 2B. Next, the control unit 2A starts rewinding the ink ribbon 9A toward the supply unit 22 side by Xr (S168), and causes the process to proceed to S13 of FIG. 9.

Figure 12A:
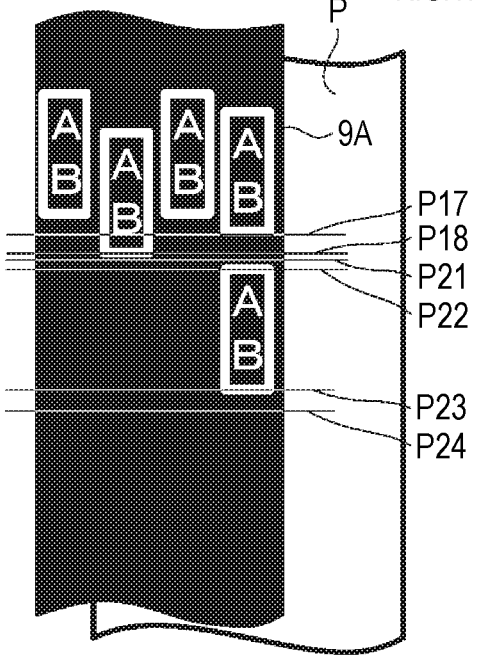
FIGS. 12A to 12D are views illustrating another used area (print mark) of the ink ribbon 9A when the transport speed of the print medium P is variable.

In the example illustrated in FIG. 12A, as one example, Xr is greater than 0 (YES in S164). The control unit 2A starts rewinding the ink ribbon 9A by Xr calculated in the process of S162 (S165), and causes the process to proceed to S13 of FIG. 9. When it is not determined that an error has occurred in the rewinding operation (NO in S13), and when it is determined that the transport of the ink ribbon 9A and the movement of the RRS are completed (YES in S15), the control unit 2A return the process to S1. The control unit 2A performs the processes of S1 to S6 in the same manner as described above, and performs printing using the area of the second column and fourth row of the ink ribbon 9A illustrated in FIG. 12A. A position P21 is the acceleration start position of the ink ribbon 9A, a position P23 is the print completion position, and a position P24 is the deceleration completion position of the ink ribbon 9A.

When it is determined that the printing is completed (YES in S6), the control unit 2A starts movement of the printing device 2 by the RRS function similarly to above (S8). Next, the control unit 2A determines whether the print use length Xp is larger than the maximum print use length Xp_max in a column (S9). When a first row of each column of the ink ribbon 9A is used and printed, the value of the maximum print use length Xp_max is reset to "0". The print use length Xp when the printing using the area of the second column and the fourth row of the ink ribbon 9A illustrated in FIG. 12A is completed is a length between the position P21 and the position P23. Accordingly, the print use length Xp is larger than the maximum print use length Xp_max. Accordingly, the control unit 2A determines that Xp>Xp_max is satisfied (YES in S9). The control unit 2A stores the print use length Xp when printing using the area of the second column and the fourth row is completed as Xp_max in the storage unit 2B by setting Xp_max as Xp (S10).

Next, the control unit 2A determines whether the row used for printing is the last row of the column (S11). The second column of the ink ribbon 9A is printed using the second column and the fourth row to the second column and the first row in order, and thus the second column and the fourth row is not the last row of the column. Accordingly, the control unit 2A does not determine that the row used for printing is the last row of the column (NO in S11).

Figure 12B:
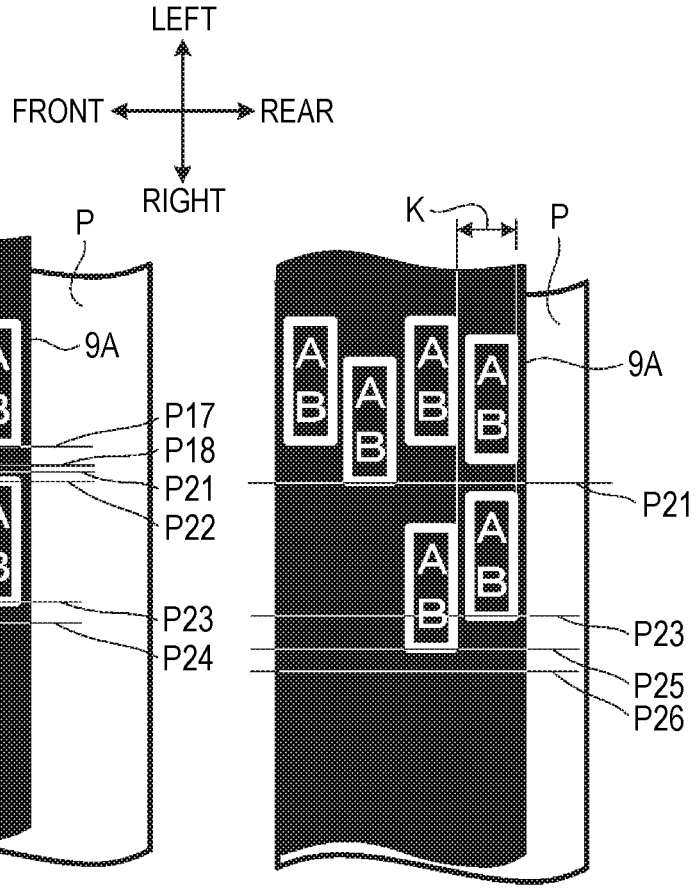

Next, the control unit 2A starts rewinding the ink ribbon 9A by setting the rewinding length Xr of the ink ribbon 9A as the forward rotation amount (S12). In the example illustrated in FIG. 12A, the ink ribbon 9A is rewound by the length (forward rotation amount) between the P21 and the P24. When it is not determined that an error has occurred in the rewinding operation (NO in S13), the control unit 2A determines whether the transport of the ink ribbon 9A and the movement of the RRS are completed (S15). When it is determined that the determination result in the determination process of S15 is YES, the control unit 2A returns the process to S1. The control unit 2A performs the processes of S1 to S6 in the same manner as described above, and performs printing using the area of the second column and the third row of the ink ribbon 9A illustrated in FIG. 12B. When the speed signal received via the controller 7 by the control unit 2A is slower than the printing using the area of the second column and the fourth row of the ink ribbon 9A, as illustrated in FIG. 12B, the used area of the second column and the third row is shifted to the right from the used area of the second column and the fourth row. A position P25 is the print completion position of the second column and the third row, and a position P26 is the deceleration completion position of the ink ribbon 9A. Accordingly, the print use length Xp (length between the position P21 and the position P25) of the used area of the second column and the third row is longer than the print use length Xp (length between the position P21 and the position P23) of the used area of the second column and the fourth row.

When it is determined that the printing is completed (YES in S6), the control unit 2A starts movement of the printing device 2 by the RRS function similarly to above (S8). Next, the control unit 2A determines whether the print use length Xp is larger than the maximum print use length Xp_max in a column (S9). The print use length Xp of the used area of the second column and the third row is longer than the print use length Xp of the used area of the second column and the fourth row stored as Xp_max in the storage unit 2B. Accordingly, the control unit 2A determines that Xp>Xp_max is satisfied (YES in S9). The control unit 2A stores the print use length Xp of the ink ribbon 9A for printing of the second column and the third row as Xp_max in the storage unit 2B (S10).

Next, the control unit 2A determines whether the row used for printing is the last row of the column (S11). Since the second column and the third row is not the last row of the column, the control unit 2A does not determine that the printed row is the last row of the column (NO in S11). The control unit 2A starts rewinding by setting the rewinding length Xr of the ink ribbon 9A as the forward rotation amount (S12). Since the transport length X (forward rotation amount) of the second column and the third row is longer than the transport length X (forward rotation amount) of the second column and the fourth row, the rewinding amount in the process of S12 becomes longer.

Figure 12C:
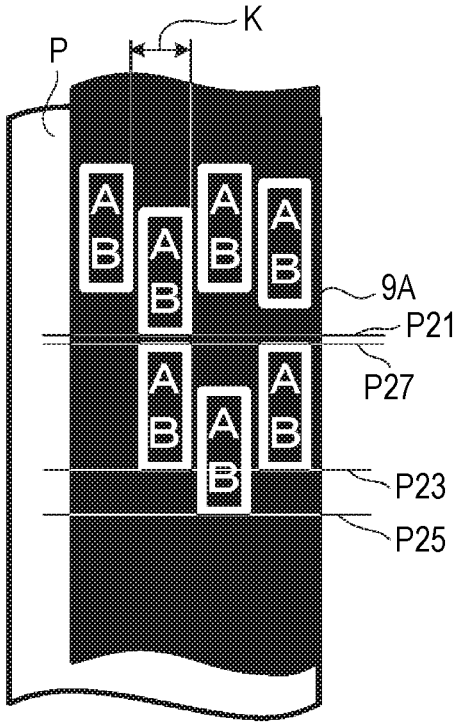

When it is not determined that an error has occurred in the rewinding operation (NO in S13), and when it is determined that the transport of the ink ribbon 9A and the movement of the RRS are completed (YES in S15), the controller 2A returns the process to S1. The control unit 2A performs the processes of S1 to S6 in the same manner as described above, and performs printing using the area of the second column and the second row of the ink ribbon 9A illustrated in FIG. 12C. When the speed signal received via the controller 7 by the controller 2A is the same as printing using the area of the second column and the fourth row of the ink ribbon 9A, as illustrated in FIG. 12C, the used area of the second column and the second row is located at the same position as the used area of the second column and the fourth row in the horizontal direction of the ink ribbon 9A. Accordingly, the print use length Xp (length between the position P21 and the position P23) of the used area of the second column and the second row is shorter than the print use length Xp (length between the position P21 and the position P25) of the used area of the second column and the third row.

When it is determined that the printing is completed (YES in S6), the control unit 2A starts movement of the printing device 2 by the RRS function similarly to above (S8). Next, the control unit 2A determines whether the print use length Xp is larger than the maximum print use length Xp_max in a column (S9). The print use length Xp of the used area of the second column and the second row is shorter than the print use length Xp of the used area of the second column and the third row stored as Xp_max in the storage unit 2B. Accordingly, the control unit 2A does not determine that Xp>Xp_max is satisfied (NO in S9). The control unit 2A causes the process to S11.

Next, since the second column and the second row is not the last row of the column, the control unit 2A does not determine that the row used for printing is the last row of the column (NO in S11). The control unit 2A starts rewinding by setting the rewinding length Xr of the ink ribbon 9A as the forward rotation amount. That is, the control unit 2A starts rewinding by the transport length X (forward rotation amount) transported in the processes of S4 to S6 (S12). The transport length X (forward rotation amount) of the second column and the second row is the same as the transport length X (forward rotation amount) of the second column and the fourth row. Accordingly, the ink ribbon 9A is rewound by the length between the position P21 and the position P23.

Figure 12D:
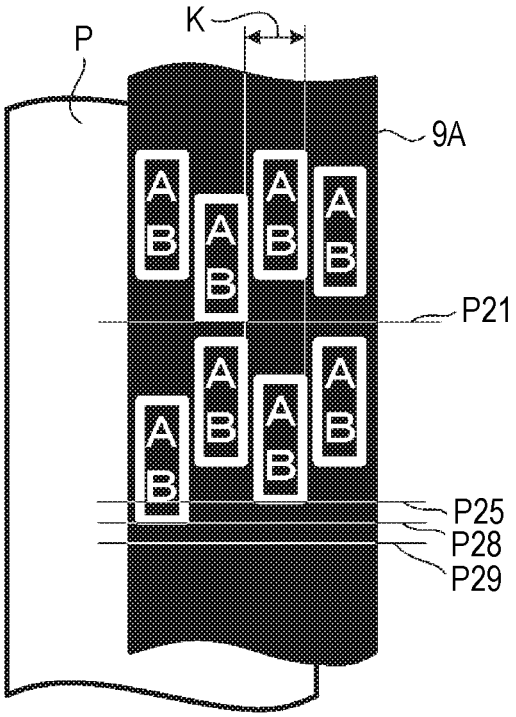

When it is not determined that an error has occurred in the rewinding operation (NO in S13), and when it is determined that the transport of the ink ribbon 9A and the movement of the printing device 2 by the RRS function are completed (YES in S15), the controller 2A returns the process to S1. The control unit 2A performs the processes of S1 to S6 in the same manner as described above, and performs printing using the area of the second column and the first row of the ink ribbon 9A illustrated in FIG. 12D. A position P28 is the print completion position, and a position P29 is the deceleration completion position of the ink ribbon 9A. When the speed signal received via the controller 7 by the controller 2A is slower than printing using the area of the second column and the fourth row to the second column and the second row of the ink ribbon 9A, as illustrated in FIG. 12D, in the horizontal direction of the ink ribbon 9A, the used area of printing using the second column and the first row is shifted to the rightmost side. Accordingly, the print use length Xp (length between the position P21 and the position P28) of the used area of the second column and the first row is longer than the print use length Xp (length between the position P21 and the position P25) of the used area of the second column and the third row.

When it is determined that the printing is completed (YES in S6), the control unit 2A starts movement of the printing device 2 by the RRS function similarly to above (S8). Next, the control unit 2A determines whether the print use length Xp is larger than the maximum print use length Xp_max in a column (S9). Since the print use length Xp of the used area of the second column and the first row is longer than the print use length Xp of the used area of the second column and the third row stored as Xp_max in the storage unit 2B, the control unit 2A determines that Xp>Xp_max is satisfied (YES in S9). The control unit 2A stores the print use length Xp of the ink ribbon 9A for printing of the second column and the first row as Xp_max in the storage unit 2B (S10).

Since the second row and the first row is the last row of the column, the control unit 2A determines that the printed row is the last row of the column (YES in S11) and calculates the rewinding length Xr (S16). The process (S16) of calculating the rewinding length Xr will be described with reference to the subroutine of FIG. 10. First, the control unit 2A determines whether Xp<Xp_max is satisfied (S161). The previous print use length Xp is the print use length (length between the position P21 and the position P28) of the second column and the first row as illustrated in FIG. 12D and is the same as Xp_max (print use length of the second column and the first row, that is, length between the position P21 and the position P28) stored in the storage unit 2B. Accordingly, the control unit 2A does not determine that Xp<Xp_max is satisfied (NO in S161). Next, the control unit 2A sets the rewinding length Xr to Xr=Xu+Xd−Xm (S167). After calculating the rewinding length Xr in the process of S167, the control unit 2A resets the value of Xp_max stored in the storage unit 2B. Next, the control unit 2A starts rewinding the ink ribbon 9A toward the supply unit 22 side by Xr (S168), and causes the process to proceed to S13 of FIG. 9.

When it is not determined that an error has occurred in the rewinding operation (NO in S13), and when it is determined that the transport of the ink ribbon 9A and the movement of the printing device 2 by the RRS function are completed (YES in S15), the control unit 2A return the process to S1. The control unit 2A performs the processes of S1 to S6 in the same manner as described above, and performs printing using the area of the third column and the first row of the ink ribbon 9A illustrated in FIG. 13A. A position P31 is the acceleration start position of the ink ribbon 9A, a position P32 is the print start position, and a position P33 is the print completion position. A position P34 is the deceleration completion position of the ink ribbon 9A.

Figure 13A:
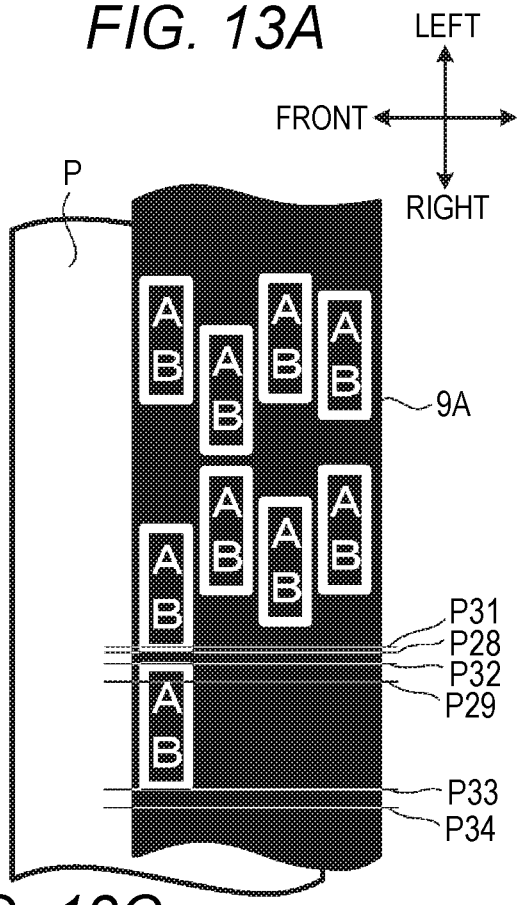
FIGS. 13A to 13D are views illustrating another used area (print mark) of the ink ribbon 9A when the transport speed of the print medium P is variable.

When it is determined that the printing is completed (YES in S6), the control unit 2A starts movement of the printing device 2 by the RRS function similarly to above (S8). Next, the control unit 2A determines whether the print use length Xp is larger than the maximum print use length Xp_max in a column (S9). When a first row of each column of the ink ribbon 9A is used and printed, the value of the maximum print use length Xp_max is reset to "0". The print use length Xp when the printing using the area of the third column and the first row of the ink ribbon 9A illustrated in FIG. 13A is completed is a length between the position P31 and the position P33. Accordingly, the print use length Xp is larger than the maximum print use length Xp_max. Accordingly, the control unit 2A determines that Xp>Xp_max is satisfied (YES in S9). The control unit 2A stores the print use length Xp when printing using the area of the third column and the first row is completed as Xp_max in the storage unit 2B by setting Xp_max as Xp (that is, Xp_max=Xp) (S10).

Next, the control unit 2A determines whether the row used for printing is the last row of the column (S11). The third column of the ink ribbon 9A is printed using the third column and the first row to the third column and the fourth row in order, and thus the third column and the first row is not the last row of the column. Accordingly, the control unit 2A does not determine that the row used for printing is the last row of the column (NO in S11).

When the control unit 2A does not determine that the row used for printing is the last row of the column (NO in S11), the control unit 2A starts rewinding the ink ribbon 9A by setting the rewinding length Xr of the ink ribbon 9A as the forward rotation (S12). In the example illustrated in FIG. 13A, the ink ribbon 9A is rewound by the length (forward rotation amount) between the P31 and the P34.

Figure 13B:
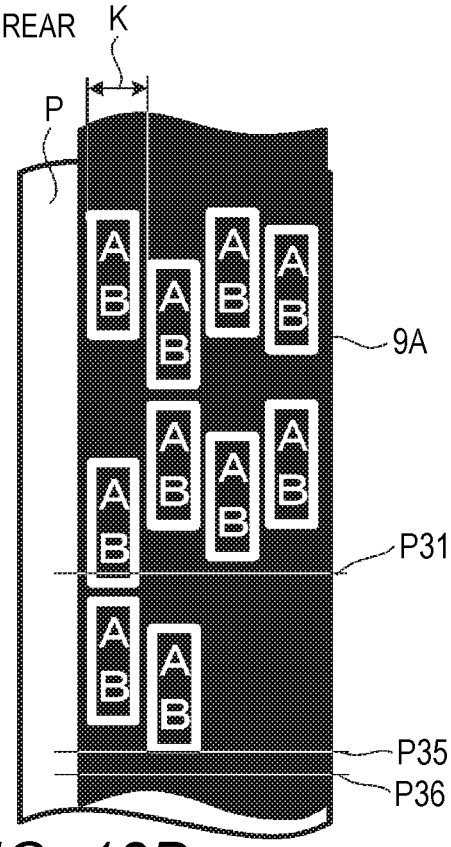

When it is not determined that an error has occurred in the rewinding operation (NO in S13), the control unit 2A determines whether the transport of the ink ribbon 9A and the movement of the printing device 2 by the RRS function are completed (S15). When it is determined that the determination result in the determination process of S15 is YES, the control unit 2A returns the process to S1. The control unit 2A performs the processes of S1 to S6 in the same manner as described above, and performs printing using the area of the third column and the second row of the ink ribbon 9A illustrated in FIG. 13B. When the speed signal received via the controller 7 by the control unit 2A is slower than the printing using the area of the third column and the first row of the ink ribbon 9A, as illustrated in FIG. 13B, the used area of the third column and the second row is shifted to the right from the used area of the third column and the first row. A position P35 is the print completion position of the third column and the second row, and a position P36 is the deceleration completion position of the ink ribbon 9A. Accordingly, the print use length Xp (length between the position P31 and the position P35) of the used area of the third column and the second row is longer than the print use length Xp (length between the position P31 and the position P33) of the used area of the third column and the first row.

When it is determined that the printing is completed (YES in S6), the control unit 2A starts movement of the printing device 2 by the RRS function similarly to above (S8). Next, the control unit 2A determines whether the print use length Xp is larger than the maximum print use length Xp_max in a column (S9). Since the print use length Xp of the used area of the third column and the second row is longer than the print use length Xp of the used area of the third column and the first row stored as Xp_max in the storage unit 2B, the control unit 2A determines that Xp>Xp_max is satisfied (YES in S9). The control unit 2A stores the print use length Xp of the ink ribbon 9A for printing of the third column and the second row as Xp_max in the storage unit 2B (S10).

Next, the control unit 2A determines whether the row used for printing is the last row of the column (S11). Since the third column and the second row is not the last row of the column, the control unit 2A does not determine that the printed row is the last row of the column (NO in S11). The control unit 2A starts rewinding by setting the rewinding length Xr of the ink ribbon 9A as the forward rotation amount (S12). Since the transport length X (forward rotation amount) of the third column and the second row is longer than the transport length X (forward rotation amount) of the third column and the first row, the rewinding amount in the process of S12 becomes longer.

Figure 13C:
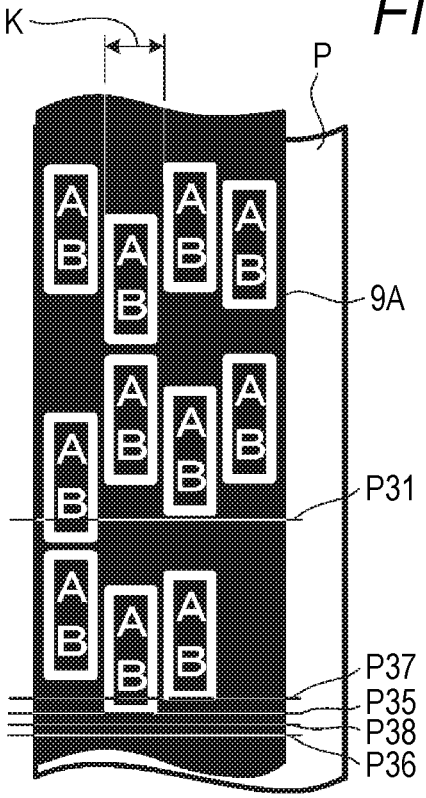

When it is not determined that an error has occurred in the rewinding operation (NO in S13), and when it is determined that the transport of the ink ribbon 9A and the movement of the RRS are completed (YES in S15), the controller 2A returns the process to S1. The control unit 2A performs the processes of S1 to S6 in the same manner as described above, and performs printing using the area of the third column and the third row of the ink ribbon 9A illustrated in FIG. 13C. When the speed signal received via the controller 7 by the control unit 2A is faster than the printing using the area of the third column and the second row of the ink ribbon 9A, as illustrated in FIG. 13C, the used area of the third column and the third row is shifted to the left from the used area of the third column and the second row. A position P37 is the print completion position of the third column and the third row, and a position P38 is the deceleration completion position of the ink ribbon 9A. Accordingly, the print use length Xp (length between the position P31 and the position P37) of the used area of the third column and the third row is shorter than the print use length Xp (length between the position P31 and the position P35) of the used area of the third column and the second row.

When it is determined that the printing is completed (YES in S6), the control unit 2A starts movement of the printing device 2 by the RRS function similarly to above (S8). Next, the control unit 2A determines whether the print use length Xp is larger than the maximum print use length Xp_max in a column (S9). Since the print use length Xp of the used area of the third column and the third row is shorter than the print use length Xp of the used area of the third column and the second row stored as Xp_max in the storage unit 2B, the control unit 2A does not determine that Xp>Xp_max is satisfied (NO in S9). The control unit 2A causes the process to S11.

Next, the control unit 2A determines whether the row used for printing is the last row of the column (S11). Since the third column and the third row is not the last row of the column, the control unit 2A does not determine that the printed row is the last row of the column (NO in S11). The control unit 2A starts rewinding by setting the rewinding length Xr of the ink ribbon 9A as the forward rotation amount (S12). Since the transport length X (forward rotation amount) of the third column and the third row is shorter than the transport length X (forward rotation amount) of the third column and the second row, the rewinding amount in the process of S12 becomes shorter.

Figure 13D:
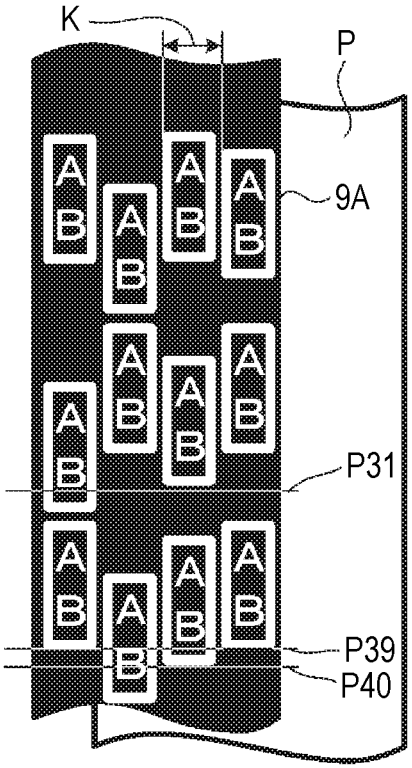

When it is not determined that an error has occurred in the rewinding operation (NO in S13), and when it is determined that the transport of the ink ribbon 9A and the movement of the printing device 2 by the RRS function are completed (YES in S15), the controller 2A returns the process to S1. The control unit 2A performs the processes of S1 to S6 in the same manner as described above, and performs printing using the area of the third column and the fourth row of the ink ribbon 9A illustrated in FIG. 13D. When the speed signal received via the controller 7 by the control unit 2A is faster than the printing using the area of the third column and the third row of the ink ribbon 9A, as illustrated in FIG. 13D, the used area of the third column and the fourth row is shifted to the left from the used area of the third column and the third row. A position P39 is the print completion position of the third column and the fourth row, and a position P40 is the deceleration completion position of the ink ribbon 9A. Accordingly, the print use length Xp (length between the position P31 and the position P39) of the used area of the third column and the fourth row is shorter than the print use length Xp (length between the position P31 and the position P37) of the used area of the third column and the third row.

When it is determined that the printing is completed (YES in S6), the control unit 2A starts movement of the printing device 2 by the RRS function similarly to above (S8). Next, the control unit 2A determines whether the print use length Xp is larger than the maximum print use length Xp_max in a column (S9). Since the print use length Xp of the used area of the third column and the fourth row is shorter than the print use length Xp of the used area of the third column and the second row stored as Xp_max in the storage unit 2B, the control unit 2A does not determine that Xp>Xp_max is satisfied (NO in S9). The control unit 2A causes the process to proceed to S11. Thereafter, the processes after S11 are repeated in the same manner as described above. When it is determined that the print stop instruction is received (YES in S2), the control unit 2A stops printing (S21), and ends the printing process. In the illustrative embodiment described above, as illustrated in FIG. 13D, the used areas (print marks) do not overlap on the ink ribbon 9A. Accordingly, it is possible to reduce the possibility of occurrence of faulty printing such as blurring on the printed image similar to the printing state of the print image on the print medium P when the transport speed of the print medium P illustrated in FIG. 6 is constant.

Main Action and Effect of this Illustrative Embodiment

In the printing system 1, after one column of the ink ribbon 9A in the width direction is used by printing with the thermal head 24, a length of use of the ink ribbon 9A, which is the longest length in one column of the ink ribbon, is stored in the storage unit 2B (S10 in FIG. 9). When printing with the thermal head 24 moves to the next one column, the next transport amount of the ink ribbon 9A is determined based on the length Xp_max stored in the storage unit 2B (S16), and the ink ribbon 9A is transported. Accordingly, the possibility of occurrence of an excess or deficiency in the transport amount of the ink ribbon 9A can be reduced. Therefore, in the transport processes (S165, S166, and S168), it is possible to reduce the possibility that the rewinding amount of the ink ribbon 9A is excessive and used areas (print marks) overlap to cause occurrence of faulty printing in the print medium P or the rewinding amount of the ink ribbon 9A is insufficient and an amount of the ink ribbon 9A not used for printing increases to cause waste.

In the printing system 1, since the ink ribbon 9A is rewound in the transport processes (S165 and S168), it is possible to reduce the possibility the rewinding amount of the ink ribbon 9A is insufficient and an amount of the ink ribbon 9A not used for printing increases to cause waste.

In the printing system 1, when printing with the thermal head 24 moves to the next one column, if the rewinding amount decreases, the rewinding amount of the ink ribbon 9A toward the supply unit 22 side decreases. Accordingly, a space between the used areas (print marks) is opened on the ink ribbon 9A, and it is possible to reduce the possibility that the used area (print mark) of the row in which the ink ribbon 9A is used first in the previous column and the used area of the corresponding row of the next column overlap each other. Therefore, it is possible to reduce the possibility that the used areas (print marks) overlap each other to cause occurrence of faulty printing.

In the printing system 1, when the transport amount Xr determined in the determination processes (S16 and S162) is negative (NO in S164), the ink ribbon 9A is fed from the supply unit side to the winding unit side in the transport process (S166). In the process of S166, the ink ribbon 9A is transported (fed) from the supply unit side to the winding unit side for an absolute value of the determined transport amount Xr. Accordingly, a space between the used areas (print marks) is opened on the ink ribbon 9A, and it is possible to reduce the possibility that the used area (print mark) of the row in which the ink ribbon 9A is used first in the previous column and the used area of the corresponding row of the next column overlap each other. Therefore, it is possible to reduce the possibility that the used areas (print marks) overlap each other to cause occurrence of faulty printing.

In the printing system 1, when the transport amount Xr determined in the determination processes (S16 and S162) is positive, the ink ribbon is rewound from the winding unit side to the supply unit side in the transport process. Accordingly, the space between the print marks is narrowed on the ink ribbon 9A, and it is possible to reduce the possibility that the space between the row in which the ink ribbon 9A is used first in the previous column and the corresponding row in the next column is narrowed to cause waste in the ink ribbon 9A.

When the transport amount Xr determined in the determination processes (S16 and S162) is zero, the printing system 1 does not transport the ink ribbon in the transport process. Accordingly, the spacing between the used areas is appropriate on the ink ribbon 9A, and it is possible to reduce the possibility that the used area of the row in which the ink ribbon is used first in the previous column and the used area of the corresponding row in the next column overlap each other or the spacing between the used areas becomes wider to cause occurrence of faulty printing or waste of the ink ribbon 9A.

Modified Example

The disclosure is not limited to the illustrative embodiment described above, and various alterations may be made thereto. In the illustrative embodiment described above, the RRS function printing process is performed by the control unit 2A of the printing device 2. In contrast, a part or all of the RRS function printing process may be executed by the control unit 7A of the controller 7 or the control unit 8A of the external apparatus 8. The control unit 2A may be internally provided with a memory, and may be used instead of the storage unit 2B. The first motor 26 and the second motor 27 may be servo motors. In this case, the transport amount such as the rewinding length Xr of the ink ribbon 9A may be controlled based on a phase. Although the control unit 2A compares the print use length Xp with the length stored as Xp_max in the storage unit 2B every time printing for one row is ended and stores the longer one as Xp_max in the storage unit 2B, the processes of S161 and S162 may be performed by storing all four print use lengths Xp of the rows of one column and using the longest print use length Xp among the print use lengths. Xp_max may be stored in a RAM (not illustrated) or the like. The used area that can be used for printing of the ink ribbon 9A in the width direction (front-and-rear direction) is not limited to four rows. The used area differs depending on a width of the ink ribbon 9A and a size of the print image.

Others

The control unit 2A, 7A and/or 8A are examples of a "controller" in the disclosure. The storage unit 2B is an example of a "storage" in the disclosure. The first motor 26 and the second motor 27 are examples of a "ribbon transport mechanism" in the disclosure. The bracket 6 is an example of a "moving mechanism" in the disclosure. The process of S12 is an example of a "rewinding process" of the disclosure. The process of S10 is an example of a "storing process" of the disclosure. The process of S16 is an example of a "determination process" of the disclosure. The processes of S165, S166, and S168 are examples of "the transport process" in the disclosure.

The foregoing description of the illustrative embodiments of the disclosure has been provided for the purposes of illustration and description. It is not intended to be exhaustive or to limit the invention to the precise forms disclosed. Obviously, many modifications and variations will be apparent to practitioners skilled in the art. The illustrative embodiments were chosen and described in order to best explain the principles of the invention and its practical applications, thereby enabling others skilled in the art to understand the invention for various illustrative embodiments and with the various modifications as are suited to the particular use contemplated. It is intended that the scope of the invention be defined by the following claims and their equivalents.

What is claimed is:

1. A printing system comprising:

a printing device comprising: a thermal head; a supplier provided on a first side and configured to supply an ink ribbon to the thermal head; a winder provided on a second side that is opposite to the first side with respect to the thermal head and configured to wind the ink ribbon; and a ribbon transport mechanism configured to transport the ink ribbon between the supplier and the winder;

a moving mechanism configured to move the printing device in a width direction of the ink ribbon;

a storage; and a controller configured to:

move the printing device in the width direction of the ink ribbon with the moving mechanism;

in a case the printing device is moved for performing printing of a second row after performing printing of a first row with the thermal head, rewind the ink ribbon from the second side to the first side with the ribbon transport mechanism;

store, in the storage, a length of use of the ink ribbon, the length stored being the longest length in a first column of the ink ribbon in the width direction;

in a case printing with the thermal head proceeds to a second column, determine a transport amount of the ink ribbon based on the length stored in the storage including the longest length in the first column of the ink ribbon in the width direction, in a case the printing with the thermal head proceeds to the second column; and after the first column in the width direction of the ink ribbon is used by the printing with the thermal head, transport the ink ribbon with the ribbon transport mechanism based on the determined transport amount.

2. The printing system according to claim 1, wherein the controller is configured to:

in the transporting, rewind the ink ribbon from the second side to the first side.

3. The printing system according to claim 1, wherein the controller is configured to:

in the determining, reduce a rewinding amount of the ink ribbon from the second side to the first side based on the length stored in the storage and determine the rewinding amount as the transport amount.

4. The printing system according to claim 1, wherein the controller is configured to:

in the transporting, in a case the determined transport amount is negative, feed the ink ribbon from the first side to the second side based on the determined transport amount.

5. The printing system according to claim 1, wherein the controller is configured to:

in the transporting, in a case the determined transport amount is positive, rewind the ink ribbon from the second side to the first side based on the determined transport amount.

6. The printing system according to claim 1, wherein the controller is configured to:

in the transporting, in a case the determined transport amount is zero, not transport the ink ribbon.

* * * * *